United States Patent [19]

Okumura et al.

[11] Patent Number: 4,830,958

[45] Date of Patent: May 16, 1989

[54] SILVER HALIDE PHOTOGRAPHIC LIGHT-SENSITIVE MATERIAL WHICH IS EXCELLENT IN RAPID PROCESSABILITY AND HAS NOT VERY MUCH SENSITIVITY VARIATION CAUSED BY A CHANGE ON STANDING IN THE PREPARATION OF THE LIGHT-SENSITIVE MATERIAL, AND THE PREPARATION PROCESS THERE

[75] Inventors: Mitsuhiro Okumura; Keiji Ohbayashi; Shigeo Tanaka, all of Hino, Japan

[73] Assignee: Konica Corporation, Tokyo, Japan

[21] Appl. No.: 147,691

[22] Filed: Jan. 25, 1988

[30] Foreign Application Priority Data

Jan. 30, 1987 [JP] Japan ..... 62-21504

[51] Int. Cl.[4] ..... G03C 1/02; G03C 1/06; G03C 1/19; G03C 5/24

[52] U.S. Cl. ..... 430/567; 430/489; 430/493; 430/569; 430/581; 430/582; 430/583; 430/584; 430/585; 430/586; 430/587; 430/588; 430/589; 430/590; 430/591; 430/592; 430/593; 430/594; 430/595; 430/603; 430/607; 430/610

[58] Field of Search ..... 430/567, 569, 603, 489, 430/493, 581–595, 610, 607

[56] References Cited

U.S. PATENT DOCUMENTS

| | | | |
|---|---|---|---|
| 4,225,666 | 9/1980 | Locker et al. | 430/570 |
| 4,469,785 | 9/1984 | Tanaka et al. | 430/550 |
| 4,472,496 | 9/1984 | Tanaka et al. | 430/542 |
| 4,564,591 | 1/1986 | Tanaka et al. | 430/567 |
| 4,581,327 | 4/1986 | Habu et al. | 430/567 |
| 4,621,041 | 11/1986 | Saikawa et al. | 430/569 |
| 4,640,890 | 2/1987 | Fujita et al. | 430/567 |
| 4,666,827 | 5/1987 | Sumi et al. | 430/567 |
| 4,729,946 | 3/1988 | Kasama et al. | 430/567 |

*Primary Examiner*—Mukund J. Shah

*Attorney, Agent, or Firm*—Jordan B. Bierman

[57] ABSTRACT

A photographic material having an excellent rapid processability, a high sensitivity and a less sensitivity variation due to a change of standing of the silver halide emulsion in the course of preparation of the light-sensitive material, and its preparation process are disclosed. The silver halide photographic light-sensitive material comprises a support bearing at least one silver halide emulsion layer thereon, and at least one silver halide emulsion layer contains highly chloride-containing silver halide grains having a silver chloride content of not less than 90 mol %, a water-soluble bromide of from 0.05 mol % to 2 mol % per mol of silver halide and a high boiling organic solvent having a dielectric constant of not higher than 6.0.

44 Claims, No Drawings

SILVER HALIDE PHOTOGRAPHIC LIGHT-SENSITIVE MATERIAL WHICH IS EXCELLENT IN RAPID PROCESSABILITY AND HAS NOT VERY MUCH SENSITIVITY VARIATION CAUSED BY A CHANGE ON STANDING IN THE PREPARATION OF THE LIGHT-SENSITIVE MATERIAL

FIELD OF THE INVENTION

This invention relates to a silver halide photographic light-sensitive material which is excellent in rapid processability and has not very much sensitivity variation caused by a change on standing in the preparation of the light-sensitive, and to the preparation process thereof.

BACKGROUND OF THE INVENTION

In recent years, with the various purposes including that of improving the productivity of photographic prints, a rapid color processing has been strongly demanaded and the various measures therefor have been taken. As one of the measures, it has been known that a color development accelerator is used when an exposed silver halide photographic light-sensitive material is developed by making use of an aromatic primary amine type color developing agent. As for the color development accelerators, there have been studied on the compounds including, for example, those described in U.S. Pat. Nos. 2,950,970, 2,515,147, 2,496,903, 4,038,075 and 4,119,462; British Pat. Nos. 1,430,998 and 1,455,413; Japanese Patent Publication Open to Public Inspection (hereinafter called Japanese Patent O.P.I. Publication) Nos. 15831-1978, 62450-1980, 62451-1980, 62452-1980, 62453-1980 and 12422-1976; Japanese Patent Publications Nos. 12422-1976 and 49728-1980; and so forth. However, most of the compounds have displayed unsatisfactory development acceleration effect. Among them, even the compounds having displayed the satisfactory development acceleration effect have not been practically applicable, because they have been so defective that fog has often been produced.

For the purpose of accelerating the permeation of a color developing agent into a silver halide light-sensitive material, various types of permeating agents have been studied. Among them, for example, there has popularly been used a method that benzyl alcohol is added to a color developer to accelerate a color development.

In this method, however, a satisfactorily high color density cannot be obtained, unless a processing is carried out for three minutes or longer at a processing temperature of 33° C., for example. Therefore, this method has, more or less, a fault from the viewpoint of rapid processability. There has also been proposed a color developing method in which a pH value of a color developer as well as a processing temperature are made higher. However, this method has some problems that, for example, the oxidation of a color developing agent is seriously accelerated when the pH thereof is raised to 10.5 or higher; a pH of a color developing agent is apt to be varied, because there is not any suitable buffer; stable photographic characteristics are, therefore, difficult to obtain; and the dependence on processing time may become greater.

On the other hand, for the purpose of making a color development more rapid, there has also been known a method in which a color developing agent is incorporated in advance into a light-sensitive material, as described in, for example, U.S. Pat. No. 3,719,492.

However, this method has defects that the raw stock stability of a silver halide photographic light-sensitive material is poor; fog is produced before using it; and fog is apt to be produced also in color developing process.

Besides the above methods, for the purpose of making inert the amine portion of the color developing agent, there is, for example, a method of incorporating the color developing agent which was made in the form of a Schiff base. This method is described in, for example, U.S. Pat. No. 3,342,559 and Research Disclosure, 1976, No. 15159. In these methods, however, a color development is not started unless the alkali-hydrolysis of the color developing agent is completed, and therefore these methods have a defect that the color development becomes rather in delay.

Japanese Patent O.P.I. Publication No. 64339-1981 discloses a method of adding 1-aryl-3-pyrazolidone having a specific structure into a silver halide color photographic light-sensitive material; and Japanese Patent O.P.I. Publication Nos. 144547-1982, 50532-1983, 50533-1983, 50534-1983, 50535-1983 and 50536-1983 each disclose the methods of adding, in advance, 1-arylpyrazolidones into a silver halide color photographic light-sensitive material and processing the light-sensitive material within a very short developing time.

However, from the viewpoint of obtaining both of a satisfactorily high color developing rate and a high color density dye-image, the techniques disclosed in the above-given specifications cannot always be satisfactory, but there are rooms for improvements.

In recent years, it has been known that a silver chloride emulsion or a silver chlorobromide emulsion having a high silver chloride content is used as a silver halide emulsion with the purpose of making a color development faster. These techniques are described in, for example, U.S. Pat. Nos. 4,183,756 and 4,225,666; Japanese Patent O.P.I. Publication Nos. 26589-1980, 91444-1983, 95339-1983, 94340-1983, 95736-1983, 106538-1983, 107531-1983, 107532-1983, 107533-1983, 108533-1983 and 125612-1983; and so forth.

The techniques described in the above patent specifications are reasonably satisfactory from the viewpoint of rapid processability and superior to the various types of rapid processing means aforementioned. They are still not satisfactory for making sensitivity faster and, further, have such a problem that the sensitivity variation thereof is serious to a change on standing particularly in preparing a light-sensitive material.

When a silver halide photographic light-sensitive material is prepared, a coating liquid for a silver halide emulsion (hereinafter called a coating liquid) is prepared in such a manner, ordinarily, that silver halide grains which were spectrally sensitized and chemically ripened are mixed together with various additives such as a binder, a surafce active agent, a hardener, a coupler, a mordant and so forth. It is well-known that a silver halide photographic light-sensitive material is completed by coating the coating liquid over to a support in various methods and then by drying it.

Upon preparation of the above-mentioned coating liquid, it is coated at a certain temperature after a lapse of several hours to some tens of hours. During that period of time, the quality of the resulted silver halide photographic light-sensitive material should constantly be stable. However, a silver halide emulsion having a high silver chloride content has a serious obstacle for practical use, because the sensitivity thereof is seriously varied with a lapse of aging time of a prepared coating liquid, as compared to the conventional silver halide emulsions having a high silver bromide.

With the purposes of preventing the characteristics, including particularly the sensitivity, of the above-mentioned coating liquid from varying during the storage, there have been proposed the measures such as; a method of adding an azole, an azaindene or the like which have been well-known as stabilizers; a method of adding such a reducing agent as a hydroquinone, a sulfinic acid or the like; a method of jointly using a specific copolymer and an optical brightening agent, as described in Japanese Patent O.P.I. Publication No. 111629-1974; a method of adding a spectral sensitizing dye as described in Japanese Patent O.P.I. Publication No. 7629-1983; a method in which a water-soluble bromide is added into a coating liquid so as to prevent a spectral sensitizing dye from desorbing in the coating liquid, as described in Japanese Patent O.P.I. Publication No. 28738-1983; and so forth. None of the above-given methods may be able to display any good effects and satisfy any characteristic requirements.

The inventors have devoted themselves to solve the above-mentioned problems and have resultingly found the unexpected fact that a coating liquid is prepared in such a manner that a specific high silver chloride containing emulsion is chemically ripened and a specific amount of a water-soluble bromide is then added thereto and further a coupler is dispersed therein by making use of a specific high boiling organic solvent, and the resulted coating liquid is used to prepared a silver halide photographic light-sensitive material which is high in sensitivity, excellent in rapid processability and less in sensitivity variation to a change on standing in the course of preparing the light-sensitive material. Thus, the inventors have been able to achieve the invention.

SUMMARY OF THE INVENTION

It is, therefore, an object of the invention to provide a silver halide photographic light-sensitive material having an excellent rapid processability, a high sensitivity and a less sensitivity variation to a change on standing in the course of preparing the light-sensitive material, and a preparation process thereof.

The above-mentioned object of the invention can be achieved; with a silver halide photographic light-sensitive material comprising a support bearing at least one silver halide emulsion layer thereon, wherein at least one silver halide emulsion layer comprises highly chloride-containing silver halide grains having a silver chloride content of not less than 90 mol %, a water-soluble bromide of from 0.05 mol % to 2 mol % per mol of silver halide and a high boiling organic solvent having a dielectric constant of not higher than 6.0, and a process for preparing a silver halide photographic light-sensitive material comprising a support bearing at least one silver halide emulsion layer thereon, comprising steps of incorprating highly chloride-containing silver halide grains having a silver chloride content of not less than 90 mol %, into at least one of silver halide emulsion layer, incorporating a water-soluble bromide of 0.05 to 2 mol % per mol of silver halide into the emulsion layer after completion of chemical ripening of the silver halide grains, further incorporating a high boiling organic solvent having a dielectric constant of not higher than 6.0 into the silver halide emulsion layer.

DETAILED DESCRIPTION OF THE INVENTION

This invention is characterized in the point that a silver halide emulsion containing high chloride-containing silver halide grains is added by a specific amount of a water-soluble bromide and a high boiling organic solvent having a dielectric constant of not higher than 6.0 and, by the synergistic effect of the addition thereof, a sensitivity variation caused by a change of a coating liquid on standing can be improved.

In the invention, the word, 'water-soluble', of the above-mentioned 'water-soluble bromide' means that not less than 0.1 g of a bromide may be dissolved in 100 g of water at 25° C. Any bromide compounds may be used, provided that it can satisfy the above-mentioned requirement. They typically include such a salt as ammonium bromide, potassium bromide, sodium bromide, lithium bromide and so forth.

The water-soluble bromides relating to the invention may be added at any point of time from the completion of the chemical ripening of a silver halide emulsion to the coating of the emulsion. For example, such a bromide is added together with or separately from such a compound as a stabilizer or the like which is to be added at the time when the chemical ripening is completed, or it is added at the time when a coating liquid is prepared. The latter is rather preferable than the former.

The water-soluble bromides relating to the invention is added in an amount within the range of from 0.05 mole % to two mole % per mole of silver halide used. A better result may be obtained when it is added in an amount of 0.1 mole % to 1.5 mole % and, more preferably, from 0.15 mole % to one mole %.

The high boiling organic solvents having a dielectric constant of not higher than 6.0, which are to be used in the invention, are added as a dispersion assistant usually when preparing a dispersing agent for such a photographic additive as a coupler, a UV absorbent, an oxidation inhibitor and so forth. However, these organic solvents may be added independently.

The high boiling organic solvents of the invention having a dielectric constant of not higher than 6.0 include, for example, esters such as a phthalate, a phosphate and so forth, organic acid amides, ketones, hydrocarbon compounds, and so forth, each having a dielectric constant of not higher than 6.0. The preferable ones include a high boiling organic solvent having a dielectric constant between not higher than 6.0 and not lower than 1.9 and a vapor pressure of not higher than 0.5 mmHg at 100° C. The more preferable ones are a phthalate or a phosphate. The organic solvents may be a mixture of not less than two kinds thereof, provided that the dielectric constants of the mixtures are not higher than 6.0. In the invention, a dielectric constant indicates that obtained at 30° C.

The phthalates advantageously used in the invention include those represented by the following Formula HA;

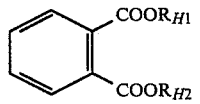

Formula HA wherein $R_{H1}$ and $R_{H2}$ represent an alkyl, alkenyl or aryl group, provided that a total number of carbon atoms of groups represented by $R_{H1}$ and $R_{H2}$ is from 9 to 32 and, more preferably, from 16 to 24.

In Formula HA, the alkyl groups represented by $R_{H1}$ and $R_{H2}$ are those straight-chained or branched, including, for example, a butyl group, a hexyl group, an octyl group, a nonyl group, a dodecyl group, a tetradecyl group, a hexadecyl group, a heptadecyl group, an octadecyl group and so forth.

The aryl groups represented by $R_{H1}$ and $R_{H2}$ include, for example, a phenyl group, a naphthyl group and so forth, and the alkenyl groups include, for example, a hexenyl group, a heptenyl group, an octadecenyl group and so forth. These alkyl group, alkenyl group and aryl group may have a single or plural substituents.

In the above-given formula, $R_{H1}$ and $R_{H2}$ represent preferably alkyl groups including, for example, a 2-ethyl-hexyl group, a 3,5,5-trimethylhexyl group, an n-octyl group, an n-nonyl group and so forth.

The phosphates are represented by the following Formula HB;

wherein $R_{H3}$, $R_{H4}$ and $R_{H5Y}$ represent an alkyl group, an alkenyl group or an aryl group, respectively, provided that a total number of carbon atoms of the groups represented by $R_{H3}$, $R_{H4}$ and $R_{H5}$ is from 24 to 54.

In Formula HB, the alkyl groups represented by $R_{H3}$, $R_{H4}$ and $R_{H5}$ are straight-chained or branched, including, for example, a butyl group, a pentyl group, a hexyl group, an octyl group, a nonyl group, a dodecyl group, a pentadecyl group, a hexadecyl group, an octadecyl group, a nonadecyl group and so forth.

These alkyl groups, alkenyl groups and aryl groups may have a single or plural substituents. The preferable alkyl groups represented by $R_{H3}$, $R_{H4}$ and $R_{H5}$ include, for example, a 2-ethylhexyl group, an n-octyl group, a 3,5,5-trimethylhexyl group, an n-nonyl group, an n-decyl group, a sec-decyl group, a sec-dodecyl group, a t-octyl group and so forth.

The typical examples of the organic solvents relating to the invention will be given below. It is, however, to be understood that the invention shall not be limited thereto.

Formula [HA]

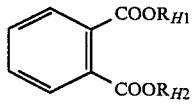

| Compound No. | $R_{H1}$ | $R_{H2}$ |
|---|---|---|
| H-1 | $-C_6H_{13}(n)$ | $-C_6H_{13}(n)$ |
| H-2 | $-CH_2CH(C_2H_5)(CH_2)_3CH_3$ | $-CH_2CH(C_2H_5)(CH_2)_3CH_3$ |
| H-3 | $-C_8H_{17}(n)$ | $-C_8H_{17}(n)$ |
| H-4 | $-C_9H_{19}(i)$ | $-C_9H_{19}(i)$ |
| H-5 | $-C_9H_{19}(n)$ | $-C_9H_{19}(n)$ |
| H-6 | $-CH_2CH_2CH(CH_3)CH_2C(CH_3)_2-CH_3$ | $-CH_2CH_2CH(CH_3)CH_2C(CH_3)_2-CH_3$ |
| H-7 | $-C_{10}H_{21}(i)$ | $-C_{10}H_{21}(i)$ |
| H-8 | $-C_{10}H_{21}(n)$ | $-C_{10}H_{21}(n)$ |
| H-9 | $-C_{11}H_{23}(i)$ | $-C_{11}H_{23}(i)$ |
| H-10 | $-C_{12}H_{25}(n)$ | $-C_{12}H_{25}(n)$ |
| H-11 | $-C_{12}H_{25}(i)$ | $-C_{12}H_{25}(i)$ |

Formula HB

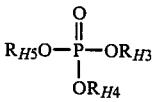

Formula [HB]

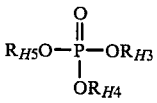

| Compound No. | $R_{H3}$ | $R_{H4}$ | $R_{H5}$ |
|---|---|---|---|
| H-12 | $-CH_2CH(C_2H_5)(CH_2)_3CH_3$ | $-CH_2CH(C_2H_5)(CH_2)_3CH_3$ | $-CH_2CH(C_2H_5)(CH_2)_3CH_3$ |
| H-13 | $-C_9H_{19}(i)$ | $-C_9H_{19}(i)$ | $-C_9H_{19}(i)$ |
| H-14 | $-C_9H_{19}(n)$ | $-C_9H_{19}(n)$ | $-C_9H_{19}(n)$ |
| H-15 | $-C_{10}H_{21}(i)$ | $-C_{10}H_{21}(i)$ | $-C_{10}H_{21}(i)$ |

-continued

Formula [HB]

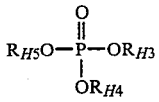

| Compound No. | $R_{H3}$ | $R_{H4}$ | $R_{H5}$ |
|---|---|---|---|
| H-16 | $-C_{10}H_{21}(n)$ | $-C_{10}H_{21}(n)$ | $-C_{10}H_{21}(n)$ |
| H-17 | $-C_{11}H_{23}(i)$ | $-C_{11}H_{23}(i)$ | $-C_{11}H_{23}(i)$ |
| H-18 | $-C_{12}H_{25}(i)$ | $-C_{12}H_{25}(i)$ | $-C_{12}H_{25}(i)$ |
| H-19 | 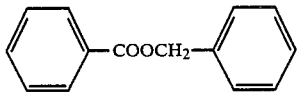 | | |
| H-20 | 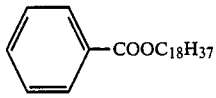 | | |
| H-21 | 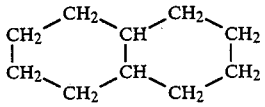 | | |
| H-22 | 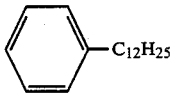 | | |

The high boiling organic solvents relating to the invention may be used in an amount within the range of from 0.01 mole to 10 moles per mole of silver halide used and, more preferably, from 0.05 mole to 5 moles. An amount of the high boiling organic solvents relating to the invention to be added to a coupler is preferably from 25 to 150% by weight to the coupler and, more preferably, from 50 to 100% by weight.

In the silver halide photographic light-sensitive materials of the invention, silver halide grains are contained in at least one silver halide emulsion layer with the purpose of satisfying a rapid processability. Such silver halide grains should necessarily be high chloride-containing silver halide grains having a silver chloride content of not less than 90 mole %. The silver chloride content preferable for the effects of the invention is not less than 95 mole % and, more preferably, not less than 99.0 mole %. The silver halide grains relating to the invention may be any of those of silver chlorobromide, silver iodochloride, silver chloroiodobromide or silver chloride, and they may contain silver iodide, however, the content thereof is preferably not more than one mole % and, more preferably, not more than 0.5 mole %. It is most preferable that no silver iodide should be contained. Namely, the silver halide grains most suitable for the invention are those of silver chlorobromide ans silver chloride.

The silver halide grains relating to the invention may be mixed up with any silver halide grains other than those of the invention. In this case, however, in a silver halide emulsion layer containing the silver halide grains relating to the invention, a ratio of the projective area occupied by the silver halide grains of the invention to the projective area occupied by the whole silver halide grain contained in the emulsion layer is preferably not less than 50% and more preferably not less than 75%.

The silver halide grains of the invention can be prepared in accordance with the methods described in, for example, Japanese Patent O.P.I. Publication Nos. 162540-1984, 48755-1984, 222844-1985, 222845-1985 and 136735-1985, and so forth.

There is no special limitation to the sizes of the silver halide grains relating to the invention. However, taking a rapid processability, sensitivity, other photographic characteristics and so forth into consideration, the grain sizes are within the range of preferably from 0.2 to 1.6 μm and more preferably from 0.25 to 1.2 μm. The above-mentioned grain sizes may be measured in various methods which have popularly been used in the art. Typical methods are described in R. P. Loveland, 'Particle-Size Measurement', ASTM Symposium on Light Microscopy, 1955, pp. 94–122; or C. E. K. Mees and T. H. James, 'The Theory of the Photographic Process', 3rd Ed., Chapter 2, The Macmillan Co., 1966. The above-mentioned grain sizes may be measure by making use of the projective area of grains or the approximate value of grain diameter. When grains are in the substantially uniform shape, the grain size distribution may be expressed rather accurately in terms of either a diameter or projective area.

With respect to the silver halide grains relating to the invention, the distribution of grain sizes thereof may be either polydispersed or monodispersed. In the grain size distribution of silver halide grains, the preferable grains are monodispersed ones having a variation coefficient of preferably not more than 0.22 and more preferably not more than 0.15. Herein, a variation coefficient means a coefficient indicating the broardness of a grain size distribution and is defined by the following equations;

$$\text{Variation coefficient } (S/\bar{r}) = \frac{\text{Std. deviation of grain size distribution}}{\text{Average grain size}}$$

-continued $$\text{Std. deviation of grain size distribution } (S) = \sqrt{\frac{\Sigma(\bar{r} - ri)^2 ni}{\Sigma ni}}$$

$$\text{Average grain size } (r) = \frac{\Sigma niri}{\Sigma ni}$$

wherein ri represents a grain size of individual grains and ni is the number thereof. The term, grain size, stated herein means the diameter of of silver halide grains when they are in the globular form or, when such grains are in the cubic form or the other forms than the cubic form, the diameter of a circular image having the same areas as the projective image areas of the grains.

The silver halide grains relating to the invention may be those prepared in any of an acidic process, a neutral process and an ammoniacal process. These grains may be grown up at a time or may be grown up after seed grains are prepared. The methods of preparing the seed grains and the methods of growing the grains may be the same with or the different from each other.

The methods of reacting a soluble silver salt with a soluble halide include a normal precipitation method, a reverse precipitation method, a double-jet precipitation method and the combinations thereof. Among the grains, those prepared in the double-jet precipitation method are preferred. Besides, as one of the double-jet precipitation methods, a pAg-controlled double-jet method may also be used as described in Japanese Patent O.P.I. Publication No. 48521-1979 and so forth.

If further required, it is also allowed to use silver halide solvents such as thioether and so forth or crystal-habit controllers such as a mercapto group-containing compound and a spectral sensitizing dye.

In the silver halide grains relating to the invention, it is allowed to use those having any configurations. One of the preferable examples is the grains in the form of cube having a [100] face as the crystal faces thereof.

Besides the above, it is also allowed to use the grains having such a form as a octahedron, tetradecahedron, dodecahedron or the like which are prepared in the methods described in, for example, U.S. Pat. Nos. 4,183,756 and 4,225,666; Japanese Patent O.P.I. Publication No. 26589-1980; Japanese Patent Publication No. 42737-1980; The Journal of Photographic Science, 21, p. 39, (1973); and so forth. It is further allowed to use the grains having twin-crystal faces or the grains having irregular forms.

As for the silver halide grains relating to the invention, each grain having a single form or the grains having various forms may either be used. However, the single formed grains are rather preferable.

In the course of forming and/or growing the silver halide grains relating to the invention, metal ions are added into the grains by making use of a cadmium salt, a zinc salt, a lead salt, a thalium salt, an iridium salt of the complex salts thereof, a rhodium salt or the complex salts thereof, an iron salt or the complex salts thereof, so that the metal ions are contained in the inside of the grains and/or in the surfaces thereof. In addition, a reduction sensitization nucleus may be provided to the inside of the grains and/or the surfaces thereof by putting the grains in a suitably reducible atmosphere.

An unnecessary soluble salts may be removed from the emulsions of the invention after completing the growth of silver halide grains, or may be contained as they are. When removing the salts, the removal may be carried out according to the method described in Research Disclosure, No. 17643.

The silver halide grains relating to the invention may be those capable of forming a latent image mainly either on the surface therof or the inside thereof. The preferable grains are those capable of forming a latent image mainly on the surface thereof.

The silver halide emulsions applicable to the invention may be chemically sensitized in accordance with an ordinary method and requirements. For example, the applicable methods include a gold sensitizing method using gold complex salts, a reduction sensitizing method using a reducible substance, a sulfur sensitizing method using a compound containing sulfur capable of reacting with silver ions or using the so-called active gelatin, a method using a noble metal salt belonging to the VIII Group of the Periodic Table, and so forth.

In particular, it is preferable that the silver halide emulsion layer of the invention contains a gold sensitizer. The gold compounds applicable thereto include, for example, chloroauric acid, sodium chloroaurate, auric potassium thiosulfate and so forth, provided there is no limitation thereto. An amount of gold compounds to be added is from $5\times10^{-7}$ to $5\times10^{-3}$ mole per mole of silver halide used, preferably from $2\times10^{-6}$ to $1\times10^{-4}$ mole, more preferably from $2.6\times10^{-6}$ to $4\times10^{-5}$ mole, and most preferably from $2.6\times10^{-6}$ to $9\times10^{-6}$ mole per mole of the silver halide used.

The point of time for adding the gold compounds is at any steps of preparing a silver halide emulsion. It is, however, preferable to add it between the time of completing a silver halide formation and the time of completing a chemical sensitization. Upon completion of a chemical sensitization and after adding a compound known as an antifoggant or a stabilizer in the photographic industry, it is also allowed to add the gold compounds into a silver halide emulsion before the emulsion is coated. In other words, it is the matter of course that not only the addition thereof may be made generally at the time when a sensitization effect may be derived from a gold sensitizer, but also at any time other than the above.

It is preferred that the silver halide emulsion layers of the invention contain a sulfur sensitizer. The sulfur sensitizers aplicable thereto include, for example, sodium thiosulfate, a thiourea derivative such as diphenyl thiourea and allyl thiourea, and so forth, provided there is no limitation thereto. Such a sulfur sensitizer may be added in an amount good enough to sensitize silver halides and there is no special limitation thereto. However, as a rough standard, sodium thiosulfate, for example, may be added in an amount of preferably from $1\times10^{-7}$ to $1\times10^{-5}$ and more preferably from $2\times10^{-6}$ to $8\times10^{-6}$ mole, per mole of silver halide used.

With the purposes of preventing a sensitivity lowering and a fog occurrence during storing or processing of a light-sensitive material, a variety of compounds may be added into the silver halide emulsions resulted as mentioned above.

As for these compounds, there are a variety of known heterocyclic compounds and mercapto compounds including 4-hydroxy-6-methyl-1,3,3*a*,7-tetraazaindene, 3-methylbenzothiazole, 1-phenyl-5-mercaptotetrazole. In particular, the mercapto compounds which may advantageously be used in the invention are represented bu the following Formula S;

Formula S

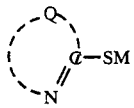

wherein Q represents a group of atoms necessary to complete a 5- or 6-membered heterocyclic ring or a 5- or 6-membered heterocyclic ring condensed with a benzene ring; and M represents a hydrogen atom or a cation.

Now, the mercapto compounds represented by Formula S will be described below.

In Formula S, Q represents a group of atoms necessary to complete a 5- or 6-membered heterocyclic ring or a 5- or 6-membered heterocyclic ring condensed with a benzene ring. The heterocyclic rings completed by Q include, for example, an imidazole ring, a tetrazole ring, a thiazole ring, an oxazole ring, a selenazole ring, a benzoimidazole ring, a naphthoimidazole ring, a benzothiazole ring, a naphthothiaazole ring, a benzoselenazole ring, a naphthoselenazole ring, a benzoxazole ring and so forth.

The cations represented by M include, for example, alkali metals such as sodium, potassium and so forth; an ammonium group; and so forth.

The mercapto compounds represented by Formula S include, preferably, those represented by the following Formulas SA, SB, SC and SD, respectively;

Formula SA

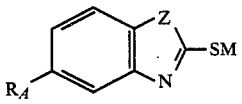

wherein $R_A$ represents a hydrogen atom, an alkyl group, an alkoxy group, an aryl group, a halogen atom, a carboxyl group or the salts thereof, a sulfo group or the salts thereof, or an amino group; Z represents —NH—, —O— or —S—; and M is synonymous with the M denoted in Formula S.

Formula SB

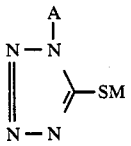

wherein Ar represents

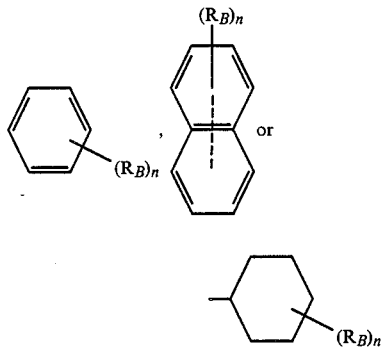

$R_8$ represents an alkyl group, an alkoxy group, a carboxyl group or the salts thereof, a sulfo group or the salts thereof, a hydroxyl group, an amino group, an acylamino group, a carbamoyl group or a sulfonamido group; n is an integer of 0, 1 or 2; and M is synonymous with the M denoted in Formula S.

In Formulas SA and SB, the alkyl groups represented by $R_A$ and $R_B$ include, for example, a methyl group, an ethyl group, a butyl group and so forth; the alkoxy groups include, for example, a methoxy group, an ethoxy group and so forth; and the salts of the carboxyl or sulfo groups include, for example, a sodium salt, an ammonium salt and so forth.

In Formula SA, the aryl groups represented by $R_A$ include, for example, a phenyl group, a naphthyl group and so forth; and the halogen atoms include, for example, a chlorine atom, a bromine atom and so forth.

In Formula SB, the acylamino groups represented by $R_B$ include, for example, a methylcarbonylamino group, a benzoylamino group and so forth; the carbamoyl groups include, for example, an ethylcarbamoyl group, a phenylcarbamoyl group and so forth; and the sulfonamido groups include, for example, a methysulfonamido group, a phenylsulfonamido group and so forth.

The above-given alkyl, alkoxy, aryl, amino, acylamino, carbamoyl, sulfonamido and the like groups include those further having substituents, respectively.

Formula SC

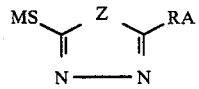

wherein Z represents $-\overset{R_{A1}}{\overset{|}{N}}-$, an oxygen atom or a sulfur atom; $R_A$ represents a hydrogen atom, an alkyl group, an aryl group, an alkenyl group, a cycloalkyl group, $-SR_{A1}$,

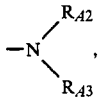

$-NHCOR_{A4}$, $-NHSO_2R_{A5}$, or a heterocyclic group; $R_{A1}$ represents a hydrogen atom, an alkyl group, an alkenyl group, a cycloalkyl group, an aryl group, $-COR_{A4}$ or $-SO_2R_{A5}$; $R_{A2}$ and $R_{A3}$ each represent a hydrogen atom, an alkyl group, or an aryl group; $R_{A4}$ and $R_{A5}$ each represent an alkyl group or an aryl group; and M is synonymous with the M denoted in Formula S.

The alkyl groups represented by $R_A$, $R_{A1}$, $R_{A2}$, $R_{A3}$, $R_{A4}$ and $R_{A5}$, respectively in Formula SC include, for example, a methyl group, a benzyl group, an ethyl group, a propyl group and so forth; and the aryl groups include, for example, a phenyl group, a naphthyl group and so forth.

The alkenyl groups represented by $R_A$ and $R_{A1}$ include, for example, a propenyl group and so forth; the cycloalkyl groups include, for example, a cyclohexyl group and so forth.

And, the heterocyclic groups represented by $R_A$ include, for example, a furyl group, a pyridinyl group and so forth.

The above-given alkyl and aryl groups represented by $R_A$, $R_{A1}$, $R_{A2}$, $R_{A3}$, $R_{A4}$ and $R_{A5}$; the alkenyl and cycloalkyl groups represented by $R_A$ and $R_{A1}$; and the heterocyclic groups represented by $R_A$; each further includes those having substituents, respectively.

Formula SD

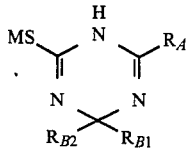

wherein $R_A$ and M each are synonymous with the $R_A$ and M denoted in Formula SC; and $R_{B1}$ and $R_{B2}$ each are synonymous with the $R_{A1}$ and $R_{A2}$ denoted in Formula SC.

The typical examples of the compounds represented by Formula S will be given below. It is, however, to be understood that the invention shall not be limited thereto.

SA-1

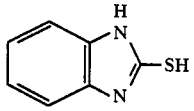

SA-2

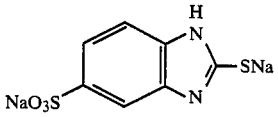

SA-3

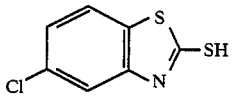

SA-4

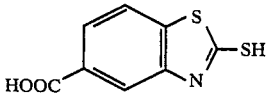

SA-5

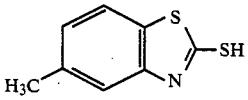

SA-6

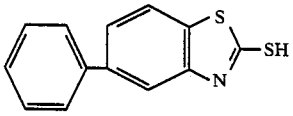

SA-7

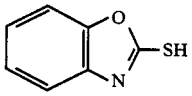

SA-8

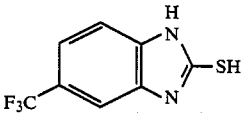

SB-1

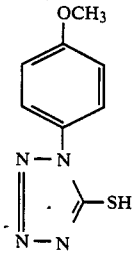

-continued

SB-2

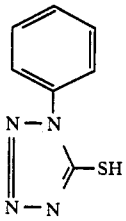

SB-3

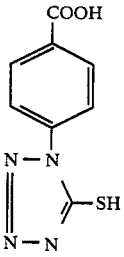

SB-4

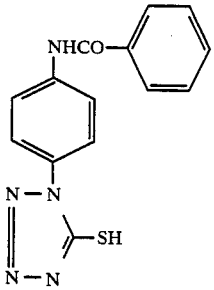

SB-5

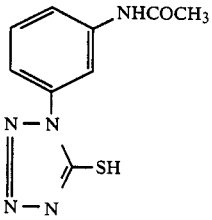

SB-6

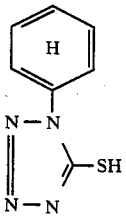

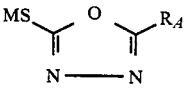

| Exemplified Compound | $R_A$ | M |
|---|---|---|
| SC-1 | $-C_2H_5$ | —H |
| SC-2 | $-CH_2-CH=CH_2$ | —H |
| SC-3 | $-CH=CH-CH_2-CH_3$ | —H |
| SC-4 | $-C_7H_{15}$ | —H |
| SC-5 | $-C_9H_{19}$ | —Na |

-continued
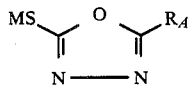
| Exemplified Compound | $R_A$ | M |
|---|---|---|
| SC-6 | 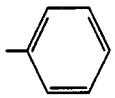 | —H |
| SC-7 | $-C_4H_9(t)$ | —H |
| SC-8 | 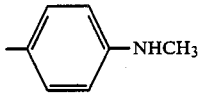 | —H |
| SC-9 | 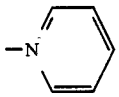 | —H |
| SC-10 | 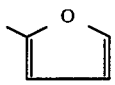 | —H |
| SC-11 | 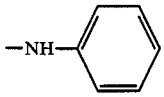 | —H |
| SC-12 | 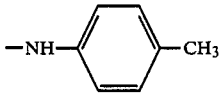 | $-NH_4$ |
| SC-13 | $-NHCOCH_3$ | —H |
| SC-14 | 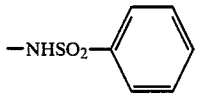 | —H |
| SC-15 | $-N(CH_3)_2$ | —H |
| SC-16 | 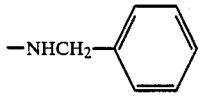 | —H |
| SC-17 | 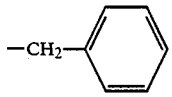 | —H |
| SC-18 | $-S-CH_3$ | —H |
| SC-19 | 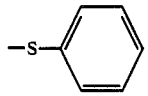 | —H |
| SC-20 | —SH | —H |
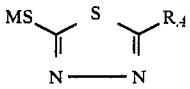
| Exemplified Compound | $R_A$ | M |
|---|---|---|
| SC-21 | —H | —H |
| SC-22 | $-C_2H_5$ | —H |
| SC-23 | $-C_4H_9(t)$ | —H |
| SC-24 | $-C_6H_{13}$ | —H |
| SC-25 | 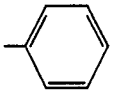 | —H |
| SC-26 | 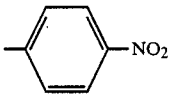 | —H |
| SC-27 | 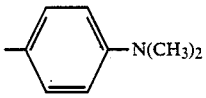 | —H |
| SC-28 | 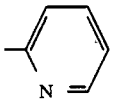 | —H |
| SC-29 | 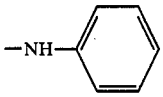 | —H |
| SC-30 | $-NH_2$ | —H |
| SC-31 | $-CH_2CH{=}CH_2$ | —H |
| SC-32 | —SH | —H |
| SC-33 | $-NHCOC_2H_5$ | —H |
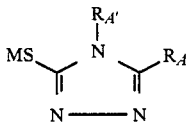
| Exemplified Compound | $R_A$ | $R_{A'}$ | M |
|---|---|---|---|
| SC-34 | $-C_2H_5$ | —H | —H |
| SC-35 | $-CH_3$ | $-CH_3$ | —H |
| SC-36 | $-CH_3$ | 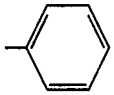 | —H |
| SC-37 | $-NHCOCH_3$ | $-CH_3$ | —H |
| SC-38 | 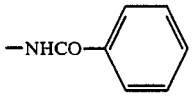 | 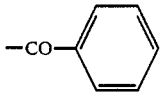 | —H |
| SC-39 | $-NHCOCH_3$ | $-COCH_3$ | —H |

-continued

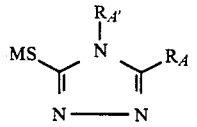

| Exemplified Compound | $R_A$ | $R_{A'}$ | M |
|---|---|---|---|
| SC-40 | $-NHCOCH_3$ | $-CH_2-$ 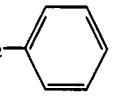 | $-H$ |

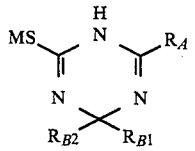

| Exemplified Compound | $R_A$ | $R_{B1}$ | $R_{B2}$ | M |
|---|---|---|---|---|
| SD-1 | $-C_2H_5$ | $-CH_3$ | $-CH_3$ | $-H$ |
| SD-2 | 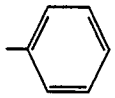 | $-CH_3$ | $-CH_3$ | $-H$ |
| SD-3 | $-NH_2$ | $-H$ | 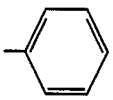 | $-H$ |
| SD-4 | $-NH-$ 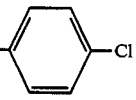 $-Cl$ | $-H$ | $-C_4H_9$ | $-H$ |
| SD-5 | $-NHCOCH_3$ | $-CH_3$ | $-CH_3$ | $-H$ |
| SD-6 | $-NHCO-$ 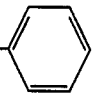 | $-CH_3$ | $-CH_3$ | $-H$ |
| SD-7 | $-NH-$ 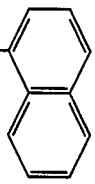 | $-CH_3$ | $-C_3H_7(i)$ | $-H$ |
| SD-8 | 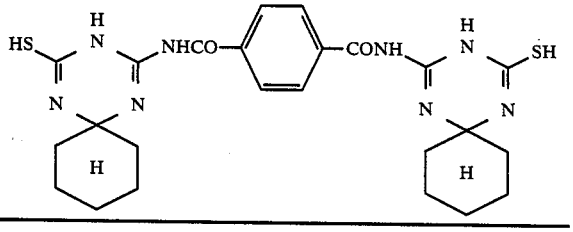 | | | |

The compounds represented by the foregoing Formula S may include the compounds described in, for example, Japanese Patent Publication No. 28496-1965; Japanese Patent O.P.I. Publication No. 89034-1975; Journal of Chemical Society, 49, 1748 (1927) and 4237 (1952); Journal of Organic Chemistry, 39, 2469 (1965); U.S. Pat. No. 2,824,001; Journal of Chemical Society, 1723 (1951); Japanese Patent O.P.I. Publication No. 111846-1981; British Pat. No. 1,275,701; U.S. Pat. Nos. 3,266,897 and 2,403,927; and so forth. These compounds may be synthesized according to the methods described in the above-given literature.

The compounds relating to the invention represented by Formula S (hereinafter called Compounds S) may be contained in a silver halide emulsion layer containing silver halide grains relating to the invention, in such a manner that a Compound S is dissolved in water or an organic solvent such as methanol, ethanol or the like which is capable of being freely mixed with water. Compounds S may be used independently, jointly with two or more kinds of Compounds S, or in combination with a stabilizer or an antifoggant other than the compounds represented by Formula S.

Compound S is usually added at the point of time when the chemical sensitization of a silve halide is completed, and may also be added at the time after silver halide grains are formed and at the time when starting or during a chemical sensitization. It is, however, preferable that Compounds S should be added in parts when starting and completing a chemical sensitization, respectively.

An amount thereof to be added is not specially limitative. However, it is within the range of usually from $1\times10^{-6}$ mole to $1\times10^{-1}$ mole and preferably from $1\times10^{-5}$ mole to $1\times10^{-2}$ mole per mole of silver halides used.

The emulsions relating to the invention may be spectrally sensitized to a desired wavelength region by making use of a dye which has been known as a spectral sensitizing dye in the photographic industry. Such a spectral sensitizing dye may be used independently or two or more kinds thereof may be used in combination. The emulsion is also allowed to contain a dye not having any spectral sensitizing function in it self or a compound not substantially absorbing any visible rays of light, i.e., a supersensitizer capable of enhancing the sensitizing function of a spectral sensitizing dye, as well as the spectral sensitizing dye.

When using the silver halide emulsion relating to the invention as a blue-sensitive emulsion, it is preferred that such an emulsion should be spectrally sensitized with a spectral sensitizing dye represented by the following Formula A;

Formula A

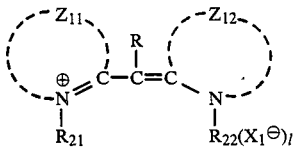

In Formula A, $Z_{11}$ and $Z_{12}$ represent a group of atoms necessary to complete a benzoxazole nucleus, a naphthoxazole nucleus, a benzoselenazole nucleus, a naphtoselenazole nucleus, a benzothiazole nucleus, a naphthothiazole nucleus, a benzoimidazole nucleus, a naphthoimidazole nucleus, a pyridine nucleus or a quinoline nucleus, and these heterocyclic rings include those having substituents. The substituents of the heterocyclic rings completed with $Z_{11}$ and $Z_{12}$ include, for example, a halogen atom, a cyano group, a methyl group, an ethyl group, a methoxy group or an ethoxy group.

$R_{21}$ and $R_{22}$ each represent an alkyl group, an alkenyl group or an aryl group and, among them, the preferable ones include an alkyl group and more preferable ones include an alkyl group substituted with a carboxyl group or a sulfo group, and the most preferable one is a sulfoalkyl group having 1 to 4 carbon atoms. $R_{23}$ represents one selected from the group consisting of a hydrogen atom, amethyl group and an ethyl group. $X^{\ominus}$ represents an anion and l is an integer of 0 or 1.

Among the spectral sensitizing dyes represented by Formula A, the particularly useful dyes are represented by the following Formula A';

Formula A'

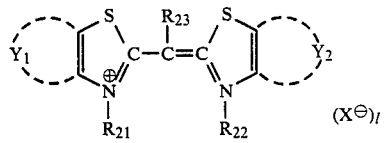

wherein $Y_1$ and $Y_2$ each represent a group of atoms necessary to complete a substitutable benzene ring or naphthalene ring. The benzene ring and the naphthalene ring completed with $Y_1$ and $Y_2$ include those having substituent. Such substituents include, preferably, a halogen atom, a cyano group, a methyl group, an ethyl group, a methoxy group or an ethoxy group.

$R_{21}$, $R_{22}$, $R_{23}$, $X^{\ominus}$ and l are synonymous with those denoted in Formula A, respectively.

The typical examples of the spectral sensitizing dyes represented by Formula A which may be used in the invention will be given below.

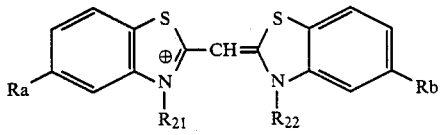

| Exemplified Compound No. | $R_{21}$ | $R_{22}$ | Ra | Rb |
|---|---|---|---|---|
| A-5 | $-CH_2CH(CH_3)SO_3^{\ominus}$ | $-CH_2-CH=CH_2$ | —H | —H |
| A-6 | $-(CH_2)_3SO_3^{\ominus}$ | $-(CH_2)_3SO_3Na$ | $-OCH_3$ | $-OCH_3$ |
| A-8 | $-(CH_2)_2COO^{\ominus}$ | $-(CH_2)_2COOH$ | —Cl | —Cl |
| A-9 | $-(CH_2)_2SO_3^{\ominus}$ | $-(CH_2)_2SO_3Na$ | $-OCH_3$ | —OH |
| A-11 | $-(CH_2)_4SO_3^{\ominus}$ | $-C_2H_5$ | —Cl | —H |
| A-12 | $-(CH_2)_3SO_3^{\ominus}$ | $-CH_2COOH$ | —Cl | —Cl |
| A-13 | $-(CH_2)_3SO_3^{\ominus}$ | $-(CH_2)_3SO_3H$ | —Cl | —Cl |

A-1

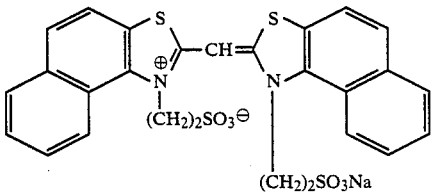

-continued

A-2

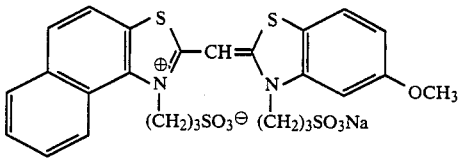

A-3

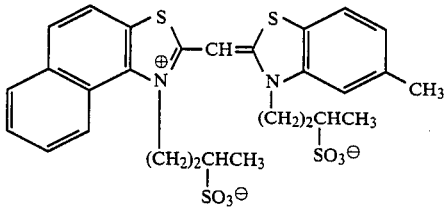

A-4

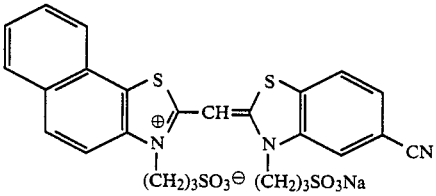

A-7

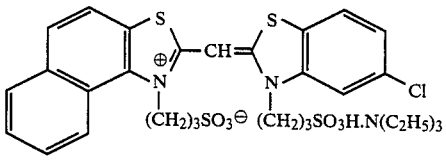

A-10

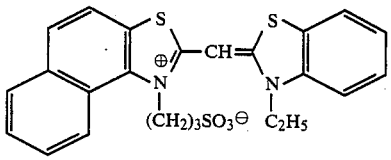

A-14

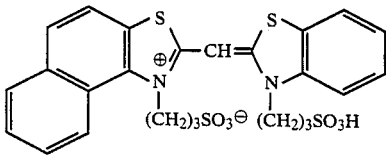

When using the silver halide emulsions relating to the invention as a green-sensitive emulsion, it is preferred to spectrally sensitize them with the spectral sensitizing dyes represented by the following Formula B;

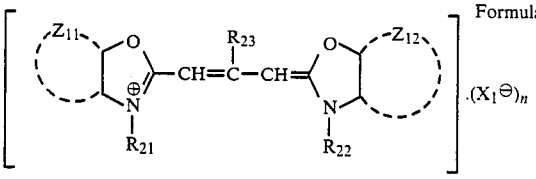

Formula B wherein $Z_{11}$ and $Z_{12}$ each represent a group of atoms necessary to complete a benzene ring or naphthalene ring each condensed with an axoazole ring, respectively. Thus completed heterocyclic ring nuclei may be substituted with a variety of substituents which include, for example, a halogen atom, an aryl group, an alkyl group or an alkoxy group. A further preferable substituent include a halogen atom, a phenyl group and a methoxy group. The most preferable substituent is a phenyl group.

According to the embodiments suitable for the invention, $Z_{11}$ and $Z_{12}$ each represent a benzene ring condensed with an oxazole ring and at least one out of these benzene rings is substituted with a phenyl group at the 5th position thereof, or one benzene ring is substituten with a phenyl group at the 5th position and the other benzene rings are substituted with a halogen atoms at the 5th positions thereof.

$R_{21}$ and $R_{22}$ each represent an alkyl group, an alkenyl group or an aryl group. Among them, preferably an alkyl group, more preferably an alkyl group substituted with a carboxyl group or a sulfo group, most preferably a sulfoalkyl group having 1 to 4 carbon atoms and further most preferably a sulfoethyl group. $R_{23}$ represents a hydrogen atom or an alkyl group having 1 to 3 carbon atoms and, preferably a hydrogen atom or an ethyl group.

$X_1^{\ominus}$ represents an anion such as halogen ions of chlorine, bromine or iodine; and an anion of

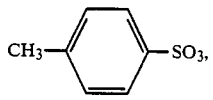

$CH_3SO_4$, $C_2H_5SO_4$ and so forth; n is an integer of one or zero, and n is 0 provided that a compound produces an intramolecular salt.

The typical examples of the spectral sensitizing dyes represented by Formula B, which may preferably be used in the invention, will be given below.

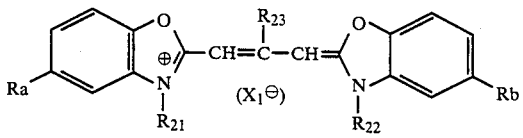

| Exemplified Compound No. | $R_{21}$ | $R_{22}$ | $R_{23}$ | Ra | Rb | $X_1^{\ominus}$ |
|---|---|---|---|---|---|---|
| B-1 | $-(CH_2)_3SO_3^{\ominus}$ | $-(CH_2)_3SO_3Na$ | $-C_2H_5$ | $-Cl$ | $-Cl$ | — |
| B-2 | $-(CH_2)_3SO_3^{\ominus}$ | $-(CH_2)_3SO_3Na$ | $-C_2H_5$ | $-OCH_3$ | $-OCH_3$ | — |
| B-3 | $-(CH_2)_4SO_3^{\ominus}$ | $-(CH_2)_4SO_3Na$ | $-C_3H_7$ | $-Br$ | $-Br$ | — |

-continued

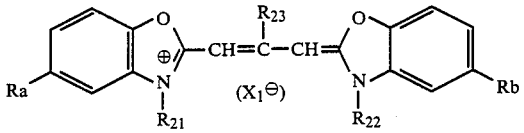

| Exemplified Compound No. | $R_{21}$ | $R_{22}$ | $R_{23}$ | Ra | Rb | $X_1^{\ominus}$ |
|---|---|---|---|---|---|---|
| B-4 | $-(CH_2)_2SO_3^{\ominus}$ | $-(CH_2)_2SO_3H$ | $-C_2H_5$ | | | — |
| B-5 | $-(CH_2)_3SO_3^{\ominus}$ | $-(CH_2)_3SO_3H$ | $-C_2H_5$ | | | — |
| B-8 | $-(CH_2)_3SO_3^{\ominus}$ | $-(CH_2)_3SO_3H$ | $-C_2H_5$ | —Cl | —H | — |
| B-10 | $-C_2H_5$ | $-C_2H_5$ | $-C_2H_5$ | —Br | —Br | $I^{\ominus}$ |
| B-11 | $-(CH_2)_3SO_3^{\ominus}$ | $-(CH_2)_3SO_3H$ | $-C_2H_5$ | | —Cl | — |

B-6

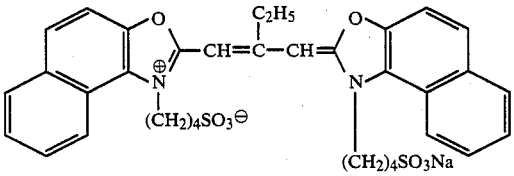

B-7

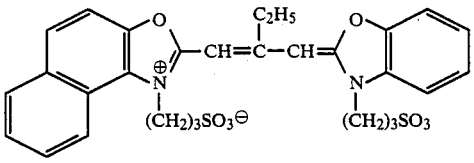

B-9

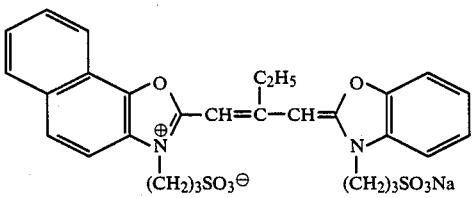

When using the silver halide emulsions relating to the invention as a red-sensitive emulsion, it is preferred to spectrally sensitize them with the spectral sensitizing dyes represented by the following Formulas C and D, respectively;

Formula C

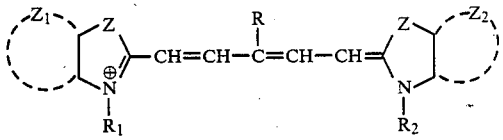

Formula D

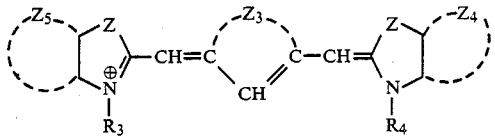

wherein R represents a hydrogen atom or an alkyl group; $R_1$ through $R_4$ each represent an alkyl group or an aryl group; $Z_1$, $Z_2$, $Z_4$ and $Z_5$ each represent a group of atoms necessary to complete a benzene ring or a naphthalene ring condensed with a thiazole ring or a selenazole ring; $Z_3$ represents a group of hydrocarbon atoms necessary to complete a 6-membered ring; l is an integer of one or two; Z represents a sulfur atom or a selenium atom; and $X^{\ominus}$ represents an anion.

In the above-given Formula, the alkyl groups represented by R include, for example, a methyl group, an ethyl group and a propyl group; and R include, preferably, a hydrogen atom, a methyl group and an ethyl group and, more preferably, a hydrogen atom amd an ethyl group.

$R_1$, $R_2$, $R_3$ and $R_4$ each represent a group selected from the group consisting of straight-chained or branched alkyl groups allowable to have substituents, such as those of methyl, ethyl, propyl, chloroethyl, hydroxyethyl, methoxyethyl, acetoxyethyl, carboxymethyl, carboxyethyl, ethoxycarbonylmethyl, sulfoethyl, sulfopropyl, sulfobutyl, β-hydroxy-γ-sulfopropyl, sulfate-propyl, allyl, benzyl and so forth; and aryl groups allowable to have substituents, such as those of phenyl, carboxyphenyl, sulfophenyl and so forth. The heterocyclic rings completed with $Z_1$, $Z_2$, $Z_4$ and $Z_5$ are allowed to have substituents including, preferably, a halogen atom, an aryl group, an alkyl group or an alkoxy group and, more preferably, a halogen atom such as a chlorine atom, a phenyl group and a methoxy group.

$X^{\ominus}$ represents an anion such as C, Br, I,

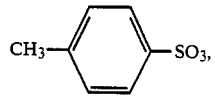

$CH_3SO_4$, $C_2H_5SO_4$ and so forth; and l is an interger of one or two.

The typical examples of the spectral sensitizing dyes preferably useful in the invention, which are represented by Formulas C and D, will be given below.

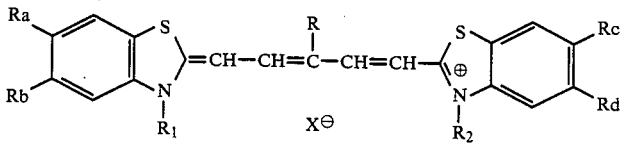

| Exemplified Compound No. | $R_1$ | $R_2$ | R | Ra | Rb | Rc | Rd | $X^{\ominus}$ |
|---|---|---|---|---|---|---|---|---|
| C-1 | $-C_2H_5$ | $-C_2H_5$ | —H | —H | —H | —H | —H | $I^{\ominus}$ |
| C-2 | $-C_2H_5$ | $-C_2H_5$ | —H | —H | $-OCH_3$ | —H | —H | $I^{\ominus}$ |
| C-3 | $-CH_2CH_2OH$ | $-C_2H_5$ | —H | —H | —H | —H | —H | $I^{\ominus}$ |
| C-4 | $-CH_2CH_2OCH_3$ | $-C_2H_5$ | —H | —H | —H | —H | —H | $Br^{\ominus}$ |
| C-5 | $-CH_2CH_2OH$ | $-CH_2CH_2OH$ | —H | —H | —H | —H | —H | $Br^{\ominus}$ |
| C-7 | $-C_2H_5$ | $+CH_2)_4SO_3^{\ominus}$ | $-CH_3$ | —H | —H | —H | —H | — |
| C-8 | $-C_2H_5$ | $+CH_2)_3SO_3^{\ominus}$ | $-CH_3$ | —H | —H | —H | —H | — |
| C-9 | $-C_2H_5$ | $-C_2H_5$ | —H | —H | 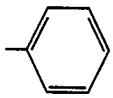 | —H | 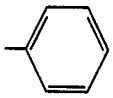 | 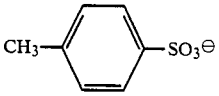 |
| C-10 | $-C_2H_5$ | $-C_2H_5$ | —H | $-OCH_3$ | $-OCH_3$ | $-OCH_3$ | $-OCH_3$ | $I^{\ominus}$ |
| C-11 | $-C_2H_5$ | $-C_2H_5$ | $-C_2H_5$ | $-CH_3$ | $-CH_3$ | $-CH_3$ | $-CH_3$ | $I^{\ominus}$ |
| C-12 | $-C_2H_5$ | $-C_2H_5$ | —H | —H | —Cl | —H | —Cl | $I^{\ominus}$ |

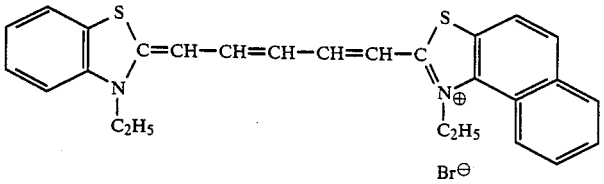

C-6

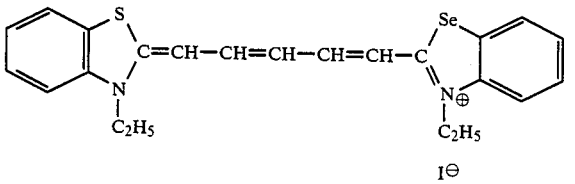

C-13

-continued

C-14

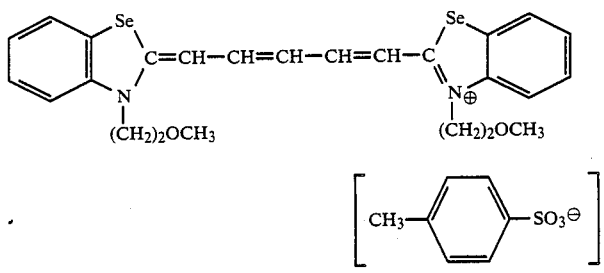

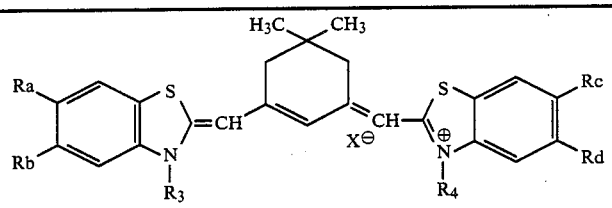

| Exemplified Compound No. | $R_3$ | $R_4$ | Ra | Rb | Rc | Rd | $X^{\ominus}$ |
|---|---|---|---|---|---|---|---|
| D-1 | $-C_2H_5$ | $-(CH_2)_3SO_3^{\ominus}$ | —H | —H | —H | —H | — |
| D-2 | $-CH_2CH_2OH$ | $-(CH_2)_3SO_3^{\ominus}$ | —H | —H | —H | —H | — |
| D-3 | $-C_2H_5$ | $-(CH_2)_3SO_3^{\ominus}$ | $-OCH_3$ | $-OCH_3$ | —H | —H | — |
| D-4 | $-C_2H_5$ | $-(CH_2)_4SO_3^{\ominus}$ | $-OCH_3$ | $-OCH_3$ | —H | —H | — |
| D-5 | $-C_2H_5$ | $-(CH_2)_3SO_3^{\ominus}$ | —H | —Cl | —H | —Cl | — |
| D-6 | $-C_2H_5$ | $-C_2H_5$ | —H | —H | —H | —H | $I^{\ominus}$ |
| D-7 | $-(CH_2)_2OH$ | $-(CH_2)_2OH$ | —H | —H | —H | —H | $Br^{\ominus}$ |
| D-8 | $-C_2H_5$ | $-C_2H_5$ | —H | $-OCH_3$ | —H | —H | 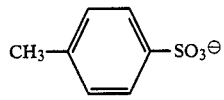 |

An amount added of the spectral sensitizing dyes represented by the above-given Formula A, B, C or D shall not be specially limited, but is within the range of preferably about $1\times10^{-7}$ to $1\times10^{-3}$ mole and, more preferably $5\times10^{-6}$ to $5\times10^{-4}$ mole, per mole of silver halide used.

As for the methods of adding such spectral sensitizing dyes, any methods well-known in the art may be used.

For example, these spectral sensitizing dyes may be added in such a manner that they are dissolved in a water-soluble solvent such as pyridine, methyl alcohol, ethyl alcohol, methyl cellosolve, acetone and so forth or the mixtures of such solvents as given above or, in some instance, they are diluted with water or, further in other instance, they are dissolved in water, so that they are added in the form of the solution thereof. In addition, when dissolving them, a supersonic oscillation may advantageously be used.

When adding the sensitizing dyes to be used in the invention, it is also allowed to apply such a method as described in U.S. Pat. No. 3,469,987, in which the dye is dissolved in a volatile organic solvent and the resulted solution is dispersed in a hydrophilic colloid and the resulted dispersion is then added; or such a method as described in Japanese Patent Publication No. 24185-1971 and so forth, in which a water-insoluble dye is dispersed without being dissolved in a water-soluble solvent and the resulted dispersion is then added. The sensitizing dyes which may be used in the invention may be added in the form of a dispersion into an emulsion in an acidic dissolution-dispersion method. As for the methods of adding the sensitizing dyes, it is also allowed to use the methods described in U.S. Pat. Nos. 2,912,345, 3,342,605, 2,996,287 and 3,425,835 and so forth.

The sensitizing dyes which are to be contained in a silver halide emulsion of the invention, may be added in such a manner that they are dissolved in the same solvents or in the different solvents from each other and the resulted solutions are mixed up together in advance of adding them into the silver halide emulsion, or they may be added separately. When adding them separately, the adding order, adding time and adding intervals may be freely determined according to the purposes of use. The point of time for adding the sensitizing dyes which are to be used in the invention into an emulsion may be at any point of time in the course of preparing the emulsion, however, preferably, during or after a chemical ripening and, more preferably, during the chemical ripening. For the purose of more improving the effects of the invention, it is preferable to add them in parts during the chemical ripening and in a coating liquid, respectively.

The silver halide photogrphic light-sensitive materials of the invention, which have the above-mentioned constitution, may be in the forms of, for example, a color negative or positive film, a color print paper and so forth. The effects of the invention can effectively be displayed particularly when using a color print paper for direct appreciation.

The silver halide photographic light-sensitive materials including the above-mentioned color print paper may be those for either monochromic use or multicolor use. In the case of the multicolor silver halide photographic light-sensitive materias, they have usually such a constitution that silver halide emulsion layers containing respectively magenta, yellow and cyan couplers each for photographic couplers and non-sensitive layers coated with the appropriate number and arrangement of the layers over to a support, so as to perform a color reproduction in a subtractive color process. The number and coarting order of the layer may suitably be changed according to the characteristics aimed and the purposes of using the light-sensitive materials to be prepared.

In the case that a silver halide photographic light-sensitive material which is to be used in the invention is a multicolor light-sensitive material, the particularly preferable layer arrangement may be typified by that, on and from a support in order, there are arranged with a yellow dye image forming layer, an interlayer, a magenta dye image forming layer, an interlayer, a cyandye image forming layer, an interlayer, and a protective layer.

There is no special limitation the the dye image forming couplers applicable to the invention, but there are a variety of couplers available to be used. They include the compounds described in the following patents as the typical examples.

The yellow dye image forming couplers include four-equivalent or two-equivalent couplers of the acylacetamide type or the benzoylmethane type. These couplers are described in, for example, U.S. Pat. Nos. 2,778,658, 2,875,057, 2,908,573, 2,908,513, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322 and 3,725,072; West German Pat. Nos. 1,547,868, 2,057,941, 2,162,899, 2,163,812, 2,213,461, 2,219,917, 2,261,361 and 2,263,875; Japanese Patent Publication No. 13576-1974; and Japanese Patent O.P.I. Publication Nos. 29432-1973, 66834-1973, 10736-1974, 122335-1974, 28834-1975, 132926-1975, 144240-1980 and 87041-1981.

The magenta dye image forming couplers include tetramer or dimer magenta dye image forming couplers of the 5-pyrazolone type, pyrazolotriazole type, pyrazolinobenzimidazole type, indazolone type and cyanoacetyl type. They are described in, for example, U.S. Pat. Nos. 2,600,788, 3,061,432, 3,062,653, 3,127,269, 3,311,476, 3,152,896, 3,419,391, 3,519,429, 3,555,318, 3,684,514, 3,705,896, 3,888,680, 3,907,571, 3,928,044, 3,930,861, 3,930,816, and 3,933,500; Japanese Patent O.P.I. Publication Nos. 29639-1974, 111631-1974, 129538-1974, 112341-1976, 58922-1977, 62454-1977, 118034-1977, 38643-1981 and 135841-1981; Japanese Patent Publication Nos. 60479-1971, 34937-1977, 29421-1980 and 35696-1980; British Pat. No. 1,247,493; Belgian Pat. Nos. 769,116; West German Pat. No. 2,156,111; Japanese Patent Publication No. 60479-1971; Japanese Patent O.P.I. Publication Nos. 125732-1984, 228252-1984, 162548-1984, 171956-1984, 33552-1985 and 43659-1985; West German Pat. No. 1,070,030; U.S. Pat. No. 3,725,067; and so forth.

The cyan dye image forming couplers include, typically four-equivalent or two-equivalent cyan dye image forming couplers of the phenol type and the napthol type. They are described in, for example, U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,985,826, 2,976,146, 3,002,836, 3,419,390, 3,446,622, 3,476,563, 3,737,316, 3,758,308 and 3,839,044; British Pat. Nos. 478,991, 945,542, 1,084,480, 1,377,233, 1,388,024 and 1,543,040; Japanese Patent O.P.I. Publication Nos. 37425-1972, 10135-1975, 25228-1975, 112038-1975, 117422-1975, 130441-1975, 6551-1976, 37647-1976, 52828-1976, 108841-1976, 109630-1978, 48237-1979, 66129-1979, 131931-1979, 32071-1980, 146050-1984, 31953-1984 and 117249-1985; and so forth.

It is desired that the above-mentioned dye forming couplers contain in the molecules thereof the so-called ballast group that is a group having not less than eight carbon atoms and is capable of making the couplers undispersed. These dye forming couplers may be either those of the four-equivalent type necessary to reduce four silver ions so as to form every molecular dye, or those of the two-equivalent type necessary to reduce two silver ions, respectively.

As for the binders which may be applicable to the silver halide photographic light-sensitive materials of the invention, gelatin or a protective colloid may advantageously be used and, besides, it is also allowed to use hydrophilic colloids including, for example, a gelatin derivative, a graft polymer of gelatin and other macromolecules, a protein, a sugar derivative, a cellulose derivative, a synthetic hydrophilic macromolecular substance such as a monomer or a copolymer, and so forth.

The silver halide photographic light-sensitive materials of the invention are also allowed to contain freely such an additive as a hardener, a color contamination inhibitor, an image stabilizer, a UV absorbent, a plasticizer, a latex, a surfactant, a matting agent, a lubricant, an antistatic agent and so forth.

With the silver halide photographic light-sensitive materials of the invention, an image may be formed through a color development process which has been known in the art.

The color developing agents applicable to the color developers used in the invention include those of the aminophenol type and p-phenylenediamine type each have widely been used in a variety of color photographic processes. The color developers applicable for processing the silver halide photographic light-sensitive materials of the invention may be added with compounds already known as a developer component, in addition to the above-mentioned aromatic primary amine type color developing agents. It is, however, more pereferable to not contain benzyl alcohol which has an environmental pollution problem.

The pH value of such color developers is normally not less than 7 and most generally from about 10 to 13.

A processing temperature of such color developers is normally not lower than 15° C. and generally within the range of from 20° to 50° C. For a rapid processing, a temperature of 30° C. or higher would be preferable. While the conventional processing time is from 3 to 4 minutes, a color processing time of the invention with the purpose of rapidly processing is generally within the range of preferably from 20 to 60 seconds and more preferably from 30 to 50 seconds.

After a color develoment is made, the silver halide photographic light-sensitive materials of the invention are then treated in a bleaching process and a fixing process. Such bleaching and fixing processes may be carried out at the same time.

After the fixing process, a washing process is ordinarily carried out. The washing process may be substituted by a stabilizing process, or the both processes may be carried out in combination.

As described above, the silver halide photographic light-sensitive materials of the invention were excellent in rapid processability, high in sensitivity and less in sensitivity variation to the change on standing in the course of preparing the light-sensitive materials.

EXAMPLES

With reference to the following embodiments of the invention, a further description will be made in more detail. It is, however, to be understood that the embodiments of the invention shall not be limited thereto.

Example 1

A monodispersed silver chlorobromide emulsion having a silver chloride content of 99.5 mole % was prepared, according to the method described in Japanese Patent O.P.I. Publication No. 48521-1979, in such a manner that, in the presence of inert gelatin and under the conditions of a temperature of 40° C., a pAg of 6.8 and a pH of 2.0, an aqueous silver nitrate solution and an aqueous solution of potassium bromide and sodium chloride were added and mixed up. As the results from an electron microscopic observation, it was found that the resulted silver halide emulsion contained cubic grains having an average grain size of 0.15 μm in terms of sphericity.

Next, a phthalated gelatin was added to the silver halide emulsion and the pH was lowered with nitric acid and the sedimentation of silver halide grains were then made. The resulted supernatant liquid was removed. The remaining matter was washed with water repeatedly and the pAg thereof was so adjusted to be 7.5. An additional inert gelating was further added so as to prepare a seed emulsion.

After then, another monodispersed silver chlorobromide emulsion having a silver chloride content of 99.6 mole % was prepared in such a manner that, under the conditions of a temperature of 40° C., a pH of 5.8 and a pAg of 7.5, a mixed solution of a part of the above-mentioned seed emulsion and gelatin was added and mixed up with an aqueous silver nitrate solution and an aqueous solution of potassium bromide and sodium chloride in an amount so as not to produce any new nucleus. The resulted silver halide emulsion were made of cubic grains having an average grain size of 0.80 μm. In the course of mixing, these grains were added with $Na_2IrCl_6.6H_2O$ in an amount of $3\times10^{-7}$ mole per mole of AgX.

Further, after the resulted silver halide emulsion was flocculated and washed in ordinary methods, the pAg was adjusted and an additional gelating was added. Still further, sodium thiosulfate in an amount of $3.5\times10^{-6}$ mole per mole of AgX, chloroauric acid in an amount of $2.7\times10^{-6}$ mole per mole of AgX, a blue-sensitive sensitizing dye, i.e., Exemplification No. A-12, in an amount of $3\times10^{-4}$ mole per mole of AgX and an exemplified mercapto compound, i.e., SB-5, in an amount of $1\times10^{-3}$ mole per mole of AgX were added at 55° C. before starting a chemical sensitization process. The resulted mixture was spectrally sensitized and chemically sensitized, and the exemplified mercapto compound, SB-2, was added in an amount of $1\times10^{-2}$ mole per mole of Agx to serve as a stabilizer at the time when the reipening process was completed, so that a ripened emulsion was prepared.

Next, dispersions were prepared in such a manner that the yellow coupler Y-1 was dispersed respectively with the exemplified high boiling organic solvents having dielectric constants shown in Table 1, namely, H-2, H-6 and H-16, dibutyl phthalate (DBP) and tricresyl phosphate (TCP), and the coating liquids were prepared by mixing the resulted dispersions with the foregoing silver halide emulsions.

In the above-mentioned preparation, potassium bromide was added to the resulted coating liquids as shown in Table 2. Then, after the coating liquids were so prepared as to have the composition shown below, the samples were prepared by coating the coating liquids over to supports, immediately after the preparation of the coating liquids, three and six hours after allowing the coating liquids to stand, respectively.

| | |
|---|---|
| Protective layer | Gelatin (5.0 g/m$^2$)<br>Hardener (HD-1) |
| Emulsion layer | Blue-sensitive emulsion (0.4 g of Ag/m$^2$)<br>Yellow coupler (Y-1) (0.8 g/m$^2$)<br>High boiling organic solvent (0.4 g/m$^2$)<br>Gelatin (3.0 g/m$^2$) |
| Support | Polyethylene-coated paper sheet |

(HD-1)

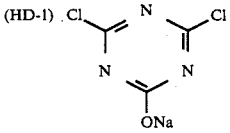

(Y-1)

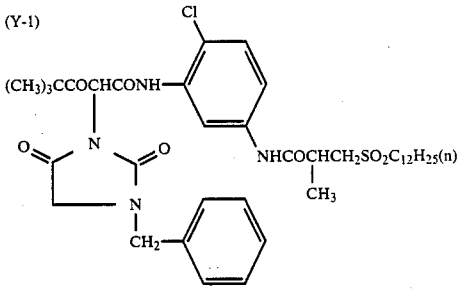

TABLE 1

| High boiling organic solvent | Dielectric constant |
|---|---|
| H-2 | 5.1 |
| H-6 | 4.6 |
| H-12 | 5.1 |
| DBP | 6.4 |
| TCP | 7.2 |

TABLE 2

| Sample No. | Amt. of potassium bromide added (Mol %/AgX mol) | High boiling organic solvent | Remark |
|---|---|---|---|
| 1 | — | H-2 | Comparison |
| 2 | 0.02 | H-2 | Comparison |
| 3 | 0.06 | H-2 | Invention |
| 4 | 0.1 | H-2 | Invention |
| 5 | 0.5 | H-2 | Invention |
| 6 | 1.0 | H-2 | Invention |
| 7 | 3.0 | H-2 | Comparison |
| 8 | 0.5 | DBP | Comparison |
| 9 | 1.0 | DBP | Comparison |
| 10 | 0.5 | TCP | Comparison |
| 11 | 1.0 | TCP | Comparison |
| 12 | — | H-6 | Comparison |
| 13 | 0.5 | H-6 | Invention |

TABLE 2-continued

| Sample No. | Amt. of potassium bromide added (Mol %/AgX mol) | High boiling organic solvent | Remark |
|---|---|---|---|
| 14 | 1.0 | H-6 | Invention |
| 15 | — | H-12 | Comparison |
| 16 | 0.5 | H-12 | Invention |
| 17 | 1.0 | H-12 | Invention |

When preparing the coating liquids used in Sample Nos. 15, 16 and 17, the blue-sensitive sensitizing dye, i.e., Exemplification No. A-12, which was used in the spectral sensitization, was further added in an amount of $7.5\times10^{-3}$ mole per mole of AgX.

Next, with respect to each of Samples-1 through-17, the sensitometric evaluation was made according to the following method.

Sensotometric evaluation

Each of the samples was exposed to light through an optical wedge by means of a sensitometer, Model KS-7 manufactured by Konishiroku Photo Industry Co., Ltd. and was then treated in the following processing steps.

Processing steps

| | Temperature | Time |
|---|---|---|
| Color developing | 34.7 ± 0.3° C. | 45 sec. |
| Bleach-fixing | 34.7 ± 0.5° C. | 45 sec. |
| Stabilizing | 30 to 34° C. | 90 sec. |
| Drying | 60 to 80° C. | 60 sec. |

Color developer

Pure water: 800 ml.
Ethylene glycol: 10 ml.
N,N-diethylhydroxylamine: 10 g
Potassium chloride: 2 g
N-ethyl-N-β-methanesulfonamidoethyl-3-methyl-4-aminoaniline sulfate: 5 g
Sodium tetrapolyphosphate: 2 g
Potassium carbonate: 30 g
Optical brightening agent (a 4,4'-diaminostilbene disulfonic acid derivative): 1 g
Water to be added to make: 1 liter
pH to be adjusted to: pH10.08

Bleach-fixer

Ferric ammonium ethylenediamine tetraacetate, dihydrate: 60 g
Ethylenediaminetetraacetic acid: 3 g
Ammonium thiosulfate (a 70% solution): 100 ml
Ammonium sulfite (a 40% solution): 27.5 ml
pH to be adjusted with potassium carbonate or glacial acetic acid to: pH7.1
Water to be added to make in total: 1 liter Stabilizer 5-chloro-2-methyl-4-isothiazoline-3-one: 1 g
1-hydroxyethylidene-1,1-diphosphoric acid: 2 g
Water to be added to make: 1 liter
pH to be adjusted with sulfuric acid or potassium hydroxide to: pH7.0

With respect to the resulted samples, the blue reflection densities thereof were measured by making use of a densitometer, Model PDA-65 manufactured by Konishiroku Photo Industry Co., Ltd. The sensitivity of each of the samples was expressed by the reciprocal of an exposure necessary to obtain a density of 0.8. In the cases that Sample 1 was standardized and that the immediately coated sample out of the respective samples was standardized, the sensitivities thereof were regarded as 100, and the sensitivities of other samples were expressed as the relative values to 100. The results thereof are shown in Table 3.

TABLE 3

| Sample No. | Relative sensitivity | Relative sensitivity to immediately coated sample regarded as 100 | | |
|---|---|---|---|---|
| | | Immediately coated | Aged for 3 hours | Aged for 6 hours |
| 1 Comp. | 100 | 100 | 82 | 71 |
| 2 Comp. | 100 | 100 | 84 | 73 |
| 3 Inv. | 108 | 100 | 96 | 93 |
| 4 Inv. | 116 | 100 | 98 | 95 |
| 5 Inv. | 127 | 100 | 97 | 96 |
| 6 Inv. | 134 | 100 | 98 | 97 |
| 7 Comp. | 138 | 100 | 90 | 84 |
| 8 Comp. | 119 | 100 | 83 | 75 |
| 9 Comp. | 125 | 100 | 86 | 79 |
| 10 Comp. | 114 | 100 | 80 | 70 |
| 11 Comp. | 120 | 100 | 82 | 72 |
| 12 Comp. | 101 | 100 | 79 | 71 |
| 13 Inv. | 120 | 100 | 98 | 96 |
| 14 Inv. | 129 | 100 | 98 | 97 |
| 15 Comp. | 98 | 100 | 83 | 75 |
| 16 Inv. | 138 | 100 | 101 | 100 |
| 17 Inv | 145 | 100 | 99 | 99 |

As is obvious from the above Table 3, in the comparative samples, i.e., Sample Nos. 1, 2, 12 and 15, in which the water-soluble bromides relating to the invention was neither used at all nor reach to the amount to be added in the invention, the sensitivity of each sample was relatively low and the desensitization thereof was serious when the coating liquids were allowed to stand. Further, even if the water-soluble bromides relating to the invention were added in an amount specified by the invention into the comparative samples, i.e., Sample Nos. 8 through No. 11, each of which were applied with a high boiling organic solvent other than those of the invention and provided with a relatively high dielectric constant, the desensitization thereof was serious when the coating liquids were allowed to stand; the sensitivity of each of the samples immediately coated was relatively high though.

In contrast to the above, it was found that the samples of the invention are capable of displaying a high sensitivity and, even if the coating liquids were allowed to stand for a long time, they still have a constant and stable sensitivity. In addition to the above, it was also found that Samples No. 16 and No. 17 each coated with a sensitizing dye-containing coating liquid are able to remarkably display the effects of the invention.

Example 2

In the same manner as in Example 1, there prepared a monodispersed cubic-crystallized emulsion having a silver chloride content of 99.3 moles and an average grains size of 0.35 μm. The resulted emulsion was chemically sensitized with sodium thiosulfate in an amount of $1\times10^{-5}$ mole per mole of AgX, chloroauric acid of $5\times10^{-6}$ mole per mole of AgX, the exemplified mercapto compound, i.e., SB-5, in an amount of $5\times10^{-3}$ mole per mole of AgX, the exemplified green-sensitive sensitizing dye, B-5 and, after the chemical sensitization was completed, there added with the exemplified mercapto compound, SB-1, in an amount of $1\times10^{-2}$ mole per mole of AgX, so that a ripened emulsion was prepared.

By making use of the resulted ripened emulsion and in the same manner as in Example 1, the water-soluble bromides shown in Table 4 was mixed in a dispersion in which the following magenta coupler, M-1, was dispersed with the exemplified high boiling organic solvents, H-2, H-7 of which the dielectric constant is shown below, and DBP, so that the coating liquids shown in Table 4 were prepared. The tests for the changes of the coating liquids on standing were tried in the same manner as in Example 1, respectively. The results thereof are shown in Table 5.

| High boiling organic solvent | Dielectric constant |
|---|---|
| H-7 | 5.3 |

M-1

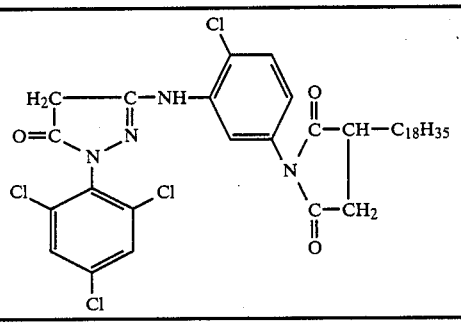

TABLE 4

| Sample No. | Amt. of potassium bromide added (Mole %/AgX mole) | High boiling organic solvent | Remark |
|---|---|---|---|
| 18 | — | H-2 | Comparison |
| 19 | 0.4 | H-2 | Invention |
| 20 | 0.8 | H-2 | Invention |
| 21 | 1.2 | H-2 | Invention |
| 22 | — | DBP | Comparison |
| 23 | 0.4 | DBP | Comparison |
| 24 | 0.8 | DBP | Comparison |
| 25 | 1.2 | DBP | Comparison |
| 26 | — | H-7 | Comparison |
| 27 | 0.4 | H-7 | Invention |
| 28 | 0.8 | H-7 | Invention |
| 29 | 1.2 | H-7 | Invention |
| 30 | 0.8 (Provided, Mercapto compound SB-1 was added at the same time) | H-7 | Invention |

TABLE 5

| Sample No. | Relative sensitivity | Relative sensitivity to immediately coated sample regarded as 100: Immediately coated | Aged for 3 hours | Aged for 6 hours |
|---|---|---|---|---|
| 18 Comp. | 100 | 100 | 86 | 80 |
| 19 Inv. | 100 | 100 | 97 | 95 |
| 20 Inv. | 118 | 100 | 101 | 98 |
| 21 Inv. | 123 | 100 | 99 | 97 |
| 22 Comp. | 98 | 100 | 82 | 71 |
| 23 Comp. | 105 | 100 | 87 | 76 |
| 24 Comp. | 113 | 100 | 86 | 79 |
| 25 Comp. | 119 | 100 | 85 | 76 |
| 26 Comp. | 101 | 100 | 86 | 82 |
| 27 Inv. | 109 | 100 | 98 | 97 |
| 28 Inv. | 117 | 100 | 99 | 97 |
| 29 Inv. | 125 | 100 | 102 | 99 |
| 30 Inv. | 112 | 100 | 98 | 96 |

It was found from the above table that Sample Nos. 19, 20, 21, 27, 28, 29 and 30 were high in sensitivity and remarkably excellent in aging stability. In contrast to the above, it was found that Sample Nos. 18, 22 and 26 not containing any potassium bromide in the coating liquids thereof were relatively low in sensitivity and inferior in aging stability, and that Sample Nos. 23, 24 and 25 in which the other high boiling solvents than those of the invention were inferior in aging stability, provided, they were rather high in sensitivity though.

Besides the above, it was also found that Sample No. 30 into which potassium bromide was added together with the mercapto compound SB-1 at the time when the chemical sensitization was completed were improved in aging stability to sensitivity though, the gradation was softened and the photographic characteristics thereof were also somewhat inferior to the other samples of the invention.

Example 3

A silver halide color photographic light-sensitive material was prepared in such a manner that the following eight layers were coated in order over to a paper support which was applied to the both sides thereof with polyethylene resin and treated by a corona discharge. Every amount added given hereinafter is in terms of an amount per sq. meter, unless otherwise especially stated.

Layer 1 . . . A layer containing 1.0 g of gelatin

Layer 2 . . . A layer containing 1.2 g of gelatin; 0.38 g in terms of silver content of a blue-sensitive silver chlorobromide emulsion which was comprised of silver chloride of 99.7 mole %. in the cubic crystal form, in an average grain size of 0.85 μm, gold-sulfur sensitized and added with blue-sensitive sensitizing dye A-12; 0.44 g of DBP or H-2 dissolved with 0.88 g of yellow coupler Y-1 and 0.015 g of 2,5-di-t-octylhydroquinone (hereinafter called HQ-1); and potassium bromide in an amount of 0.5 mole % per mole of AgX.

Layer 3 . . . A layer containing 0.7 g of gelatin

Layer 4 . . . A layer containing 1.25 g of gelatin; 0.32 g of a green-sensitive silver chlorobromide emulsion which was comprided of silver chloride of 99.5 mole %. in the cubic crystal form, in an average grain size of 0.38 μm, gold-sulfur sensitized and added with green-sensitive sensitizing dye B-5; 0.2 g of DBP or H-2 dissolved with 0.53 g of magenta coupler M-1 and 0.015 g of HQ-1; and potassium bromide in an amount of 0.6 mole % per mole of AgX.

Layer 5 . . . A layer containing 1.2 of gelatin; and 0.35 g of DBP dissolved therein with 0.08 of HQ-1 and 0.5 g of UV absorbent UV-1

Layer 6 . . . A layer containing 1.4 g of gelatin; 0.25 g of a red-sensitive silver chlorobromide emulsion which was comprided of silver chloride of 99.3 mole %. in the cubic crystal form, in an average grain size of 0.45 μm, gold-sulfur sensitized and added with red-sensitive sensitizing dye D-8; 0.18 g of DBP or H-2 dissolved with 0.50 g of the exemplified cyan coupler C-1 and 0.02 g of HQ-1; and potassium bromide in an amount of 1.0 mole % per mole of AgX.

Layer 7 . . . A layer containing 1.0 g of gelatin; and 0.14 g of DBP dissolved therein with 0.032 g of HQ-1 and 0.2 g of UV absorbent UV-1.

Layer 8 . . . A layer containing 0.5 g of gelatin

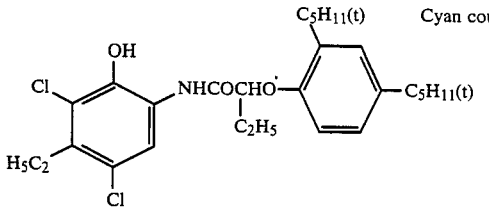

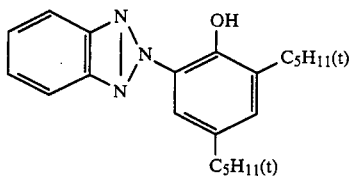

Into layers 1, 3, 5 and 8, HD-1 was further added as a hardener, so that each of the amounts added thereto was to be 0.017 g per g of the gelatin, respectively.

In the above sample, the points of time when adding the water-soluble substances and high boiling organic solvents into the emulsion layers were selected to be the same as in Example 1. In the same manner as in Examples 1 and 2, after an emulsion coating liquid was prepared, the coated samples were prepared by coating the resulted coating liquid immediately after the liquid was prepared, three hours thereafter and six hours thereafter, respectively. Then, the sensitometries were similarly carried out. The results thereof are shown in Table 6, below.

TABLE 6

| Sample No. | High boiling organic solvent | Layer | Relative sensitivity Immediate | After 3 hus | After 6 hus | Remark |
|---|---|---|---|---|---|---|
| 31 | DBP | Blue sensitive layer | 100 | 82 | 70 | Comparative sample |
| | | Green sensitive layer | 100 | 87 | 78 | |
| | | Red sensitive layer | 100 | 75 | 61 | |
| 32 | H-2 | Blue-sensitive layer | 100 | 101 | 98 | Invention sample |
| | | Green sensitive layer | 100 | 100 | 99 | |
| | | Red sensitive layer | 100 | 98 | 96 | |

As is obvious from the above Table, in Sample No. 31 which was applied with DBP and contained potassium bromide, it was found that every three layers thereof were desensitized when the coating liquid was aged and the color sensitivities thereof were also seriously unbalanced, while, in contrast to the above, in Sample 32 relating to the invention, it was found that the aging stability thereof was remarkably improved and the sensitivity balance thereof was also excellent, so that the sample relating to the invention was an excellent silver halide color photographic light-sensitive material.

What is claimed is:

1. A silver halide photographic light-sensitive material comprising a support bearing at least one silver halide emulsion layer thereon, wherein at least one silver halide emulsion layer comprises highly chloride-containing silver halide grains having a silver chloride content of not less than 90 mol %, a water-soluble bromide of from 0.05 mol % to 2 mol % per mol of silver halide, and a high boiling organic solvent having a dielectric constant of not higher than 6.0.

2. The silver halide photographic light-sensitive material of claim 1, wherein an amount of said water-soluble bromide contained in said silver halide emulsion layer is from 0.1 mol % to 1.5 mol % per mol of silver halide.

3. The silver halide photographic light-sensitive material of claim 2, wherein an amount of said water soluble-bromide contained in said silver halide emulsion layer is from 0.15 mo/ % to 1 mol % per mol of silver halide.

4. The silver halide photographic light-sensitive material of claim 1, wherein said high boiling organic solvent is selected from the group consisting of a phthalic ester, a phosphoric ester, an organic acid amide, a keton and a hydrocarbon which have a dielectric constant of not higher than 6.0.

5. The silver halide photographic light-sensitive material of claim 4, wherein said high boiling organic solvent is selected from a phthalic ester and phosphoric ester which have a dielectric constant of not higher than 6.0.

6. The silver halide photographic light-sensitive material of claim 5, wherein said high boiling organic solvent is a phthalic ester represented by the following formula HA:

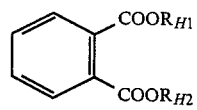

Formula HA wherein $R_{H1}$ and $R_{H2}$ represent an alkyl group, an alkenyl group or an aryl group, provided that a total number of carbon atoms of groups represented by $R_{H1}$ and $R_{H2}$ is from 9 to 32.

7. The silver halide photographic light-sensitive material of claim 5, wherein said high boiling organic solvent is a phosphoric ester represented by the following formula HB:

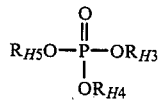

Formula HB wherein $R_{H3}$, $R_{H4}$ and $R_{H5}$ represent an alkyl group, an alkenyl group or an aryl group, respectively, provided that a total number of carbon atoms of the groups represented by $R_{H3}$, $R_{H4}$ and $R_{H5}$ is from 24 to 54.

8. The silver halide photographic light-sensitive material of claim 1, wherein an amount of said high boiling organic solvent contained in said silver halide emulsion layer is from 0.01 mol to 10 mol per mol of silver halide.

9. The silver halide photographic light-sensitive material of claim 8, wherein an amount of said high boiling organic solvent contained in said silver halide emulsion layer is from 0.05 mol to 5 mol per mol of silver halide.

10. The silver halide photographic light-sensitive material of claim 1, wherein the silver chloride content of said silver halide grains is not less than 95 mol %.

11. The silver halide photographic light-sensitive material of claim 10, wherein the silver chloride content of said silver halide grains is not less than 99 mol %.

12. The silver halide photographic light-sensitive material of claim 1, wherein said silver halide grains have an average grain size of from 0.2 μm to 1.6 μm.

13. The silver halide photographic light-sensitive material of claim 12, wherein said silver halide grains have an average grain size of from 0.25 μm to 1.2 μm.

14. The silver halide photographic light-sensitive material of claim 1, wherein said silver halide grains have a grain size distribution represented by a variation coefficient of not more than 0.22.

15. The silver halide photographic light-sensitive material of claim 14, wherein said silver halide grains have a grain size distribution represented by a variation coefficient of not more than 0.15.

16. The silver halide photographic light-sensitive material of claim 1, wherein said silver halide emulsion layer contains a mercapto compound represented the following formula S:

Formula S

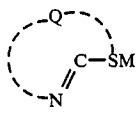

wherein Q represents a group of atoms necessary to complete a five- or six-membered heterocyclic ring condensed with a benzene ring and M represents a hydrogen atom ar a cation.

17. The silver halide photographic light-sensitive material of claim 16, wherein an amount of said mercapto compound represented by the formula S contained in said silver halide emulsion layer is from $1\times10^{-6}$ to $1\times10^{-1}$ mole per mol of silver halide.

18. The silver halide photographic light-sensitive material of claim 17, wherein an amount of said mercapto compound represented by the formula S contained in said silver halide emulsion layer is from $1\times10^{-5}$ to $1\times10^{-2}$ mol per mol of silver halide.

19. The silver halide photographic light-sensitive material of claim 1, wherein the silver halide emulsion of said silver halide emilsion layer is sensitized by a sensitizing dye represented by the following formula A:

Formula A

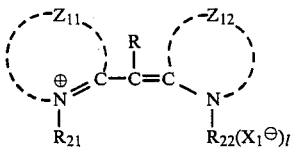

wherein $Z_{11}$ and $Z_{12}$ represent a group of atoms necessary to complete a benzoxazaole nucleus, a naphthoxazole nucleus, a benzoselenazole nucleus, a naphthoselenazole nucleus, a benzothiazole nucleus, a naphthothiazole nucleus, a benzoimidazole nucleus, a naphthoimidazole nucleus, a pyridine nucleus or quinoline nucleus, respectively; $R_{21}$ and $R_{22}$ represent an alkyl group, an alkenyl group or an aryl group, respectively; $X_1\ominus$ represents an anion and l is an integer of 0 or 1.

20. The silver halide photographic light-sensitive material of claim 1, wherein the silver halide emulsion of said silver halide emulsion layer is sensitized by a sensitizing dye represented by the following formula B:

Formula B

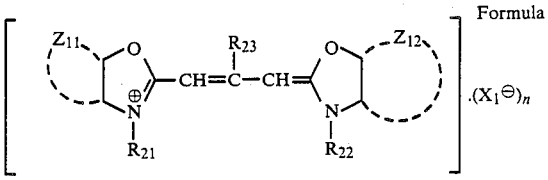

wherein $Z_{11}$ and $Z_{12}$ represent a group of atoms necessary to complete a benzene ring or a naphthalene ring which are condensed with a oxazole ring, respectively, $R_{21}$ and $R_{22}$ represent an alkyl group, an alkenyl group or an aryl group, respectively; $X_1\ominus$ represents an anion and n is an integer of 0 or 1.

21. A process for preparing a silver halide photographic light-sensitive material comprising a support bearing at least one silver halide emulsion layer thereon, comprising steps of incorprating highly chloride-containing silver halide grains having a silver chloride content of not less than 90 mol %, into at least one of silver halide emulsion layer, incorporating a water-soluble bromide of from 0.05 mol % to 2 mol % per mol of silver halide into said emulsion layer after completion of chemical ripening of said silver halide grains, and further incorporating a high boiling organic solvent having a dielectric constant of not higher than 6.0 into said silver halide emulsion emulsion layer.

22. The process for prearing a silver halide photographic light-sensitive material of claim 21, wherein said water-soluble bromide is incorporated into the silver halide emulsion of said silver halide emulsion layer at the time when an emulsion is prepared to a coating liquid for preparing said silver halide emulsion layer.

23. The process for preparing a silver halide photographic light-sensitive material of claim 21, wherein an amount of said water-soluble bromide incorporated into said silver halide emulsion is from 0.1 to 1.5 mol % per mol of silver halide.

24. The process of preparing a silver halide photographic light-sensitive material of claim 23, wherein an amount of said water-soluble bromide incorporated into said silver halide emulsion is 0.15 to 1 mol % per mol of silver halide.

25. The process of preparing a silver halide photographic light-sensitive material of claim 21, wherein said high boiling organic solvent is selected from the group consisting of a phthalic ester, a phosphoric ester, an organic acid amide, a keton and a hydro carbon which have a dielectric constant of not higher than 6.0.

26. The process of preparing a silver halide photoraphic light-sensitive material of claim 25, wherein said high boiling organic solvent is selected from a phthalic ester and a phosphoric ester which have a dielectric constant of not higher than 6.0.

27. The process of preparing a silver halide photographic light-sensitive material of claim 26, wherein said phthalic ester is represented by the following formula HA.

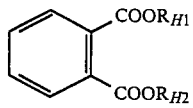

Formula HA wherein $R_{H1}$ and $R_{H2}$ represent an alkyl group, an alkenyl group or an aryl group, provided that a total number of carbon atoms of groups represented by $R_{H1}$ and $R_{H2}$ is from 9 to 32.

28. The process for preparing a silver halide photographic light-sensitive material of claim 26, wherein said phosphoric ester is represented by the following formula HB:

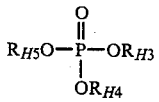

Formula HB wherein $R_{H3}$, $R_{H4}$ and $R_{H5}$ represent an alkyl group, an alkenyl group or an aryl group, respectively, provided that a total number of carbon atoms of the groups represented by $R_{H3}$, $R_{H4}$ and $R_{H5}$ is from 24 to 54.

29. The process for preparing a silver halide photographic light-sensitive material of claim 21, wherein an amount of said high boiling organic solvent incorporated into said silver halide emulsion layer is from 0.01 mol to 10 mol per mol of silver halide.

30. The process for preparing a silver halide photographic light-sensitive material of claim 30, wherein an amount of said high boiling organic solvent incorporated into said silver halide emulsion layer is from 0.05 mol to 5 mol per mol of silver halide.

31. The process for preparing a silver halide photographic light-sensitive material of claim 21, wherein an amount of silver chloride incorporated into said silver halide grains is not less than 95 mol %.

32. The process for preparing a silver halide photographic light-sensitive material of claim 31, wherein an amount of silver chloride incorporated into said silver halide grains is not less than 99 mol %.

33. The process for preparing a silver halide photographic light-sensitive material of claim 21, wherein said silver halide grains have an average grain size of from 0.2 μm to 1.6 μm.

34. The process for preparing a silver halide photographic light-sensitive material of claim 33, wherein said silver halide grains have an average grain size of from 0.25 μm to 1.2 μm.

35. The process for preparing a silver halide photographic light-sensitive material of claim 21, wherein said silver halide grains have a grain size distribution represented by a variation coefficient of not more than 0.22.

36. The process for preparing a silver halide photographic light-sensitive material of claim 35, wherein said silver halide grains have a grain size distribution represented by a variation coefficient not more than 0.15.

37. The process for preparing a silver halide photographic light-sensitive material of claim 21, wherein a mercapto compound represented by the following formula S is incorporated into said silver halide emulsion layer:

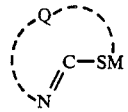

Formula S wherein Q represents a group of atoms necessarry to complete a five- or six-membered heterocyclic ring condensed with a benzene ring and M represents a hydrogen atom ar a cation.

38. The process for preparing a silver halide photographic light-sensitive material of claim 37, wherein said mercapto compound represented by the formula S is incorporated in parts into the silver halide emulsion of said silver halide emulsion layer at the time of initiation and of completion of a chemical ripening of said silver halide emulsion.

39. The process for preparing a silver halide photographic light-sensitive material of claim 37, wherein an amount of said mercapto compound represented by the formula S incorporated into said silver halide emulsion layer is from $1\times10^{-6}$ to $1\times10^{-1}$ mol per mol of silver halide.

40. The process for preparing a silver halide photographic light-sensitive material of claim 39, wherein an amount of said mercapto compound represented by the formula S incorporated into said silver halide emulsion layer is from $1\times10^{-5}$ to $1\times10^{-2}$ mol per mol of silver halide.

41. The process for preparing a silver halide photographic light-sensitive material of claim 21, wherein the silver halide emulsion of said silver halide emulsion layer is sensitized by a sensitizing dye represented by the following formula A:

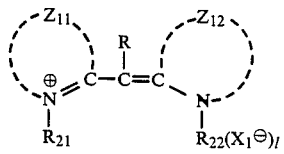

Formula A wherein $Z_{11}$ and $Z_{12}$ represent a group of atoms necessary to complete a benzoxazaole nucleus, a naphthoxazole nucleus, a benzoselenazole nucleus, a naphthoselenazole nucleus, a benzothiazole nucleus, a naphthothiazole nucleus, a benzoimidazole nucleus, a naphthoimidazole nucleus, a pyridine nucleus or quinoline nucleus, respectively, $R_{21}$ and $R_{22}$ represent an alkyl group, an alkenyl group or an aryl group, respectively; $X_1\ominus$ represents an anion and l is an integer of 0 or 1.

42. The process for preparing a silver halide photographic light-sensitive material of claim 21, wherein the silver halide emulsion of said silver halide emulsion layer is sensitized by a sensitizing dye represented by the following formula B:

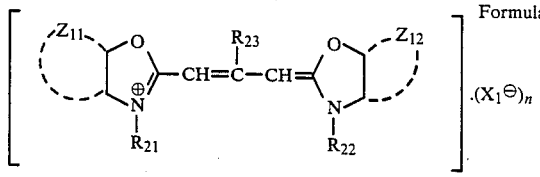

Formula B wherein $Z_{11}$ and $Z_{12}$ represent a group of atoms necessary to complete a benzene ring or a naphthalene ring which are condensed with a oxazole ring, respectively; $R_{21}$ and $R_{22}$ represent an alkyl group, an alkenyl group or an aryl group, respectively; $X_1\ominus$ represents an anion and n is an integer of 0 or 1.

43. A process for processing a silver halide photographic light-sensitive material comprising a steps of developing said silver halide photographic material with a color developer within a time of from 30 seconds to 50 seconds, wherein said silver halide photographic light-sensitive material comprises a support bearing at least one silver halide emulsion layer thereon, in which at least one silver halide emulsion layer comprises highly chrolide-containing silver halide grains having a silver chrolide content of not less than 90 mol %, a water-soluble bromide of from 0.05 mol % to 2 mol % per mol of silver halide, and a high boiling organic solvent having a dielectric constant of not higher than 6.0.

44. A process for processing a silver halide photographic light-sensitive material comprising a step for developing said silver halide photographic light-sensitive material with a color developer containing no benzyl alcohol, wherein said silver ahlide photographic light-sensitive material comprises a support bearing at least one silver halide emulsion layer thereon, in which at least one silver halide emulsion comprises highly chrolide-containing silver halide grains having a silver halide content of not less than 90 mol %, a water-soluble bromide of from 0.05 mol % to 2 mol % per mol of silver halide, and a high boiling organic solvent having a dielectric constant of not more than 6.0.

* * * * *